US009214148B2

(12) United States Patent
Kato et al.

(10) Patent No.: US 9,214,148 B2
(45) Date of Patent: Dec. 15, 2015

(54) ACOUSTIC STRUCTURE

(71) Applicant: Yamaha Corporation, Hamamatsu-shi, Shizuoka-ken (JP)

(72) Inventors: Shinichi Kato, Hamamatsu (JP); Yoshikazu Honji, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 13/952,797

(22) Filed: Jul. 29, 2013

(65) Prior Publication Data

US 2014/0034413 A1 Feb. 6, 2014

(30) Foreign Application Priority Data

Jul. 31, 2012 (JP) ..... 2012-170553

(51) Int. Cl.

| | |
|---|---|
| ***E04B 1/86*** | (2006.01) |
| ***G10K 11/00*** | (2006.01) |
| ***G10K 11/172*** | (2006.01) |
| *E04B 1/84* | (2006.01) |

(52) U.S. Cl.

CPC ..... *G10K 11/002* (2013.01); *G10K 11/172* (2013.01); *E04B 1/86* (2013.01); *E04B 2001/8485* (2013.01)

(58) Field of Classification Search

CPC ..... G10K 11/002; G10K 11/172; E04B 1/86; E04B 2001/8485

USPC ..... 181/210, 293, 295, 286; 52/144, 145

See application file for complete search history.

(56) References Cited

U.S. PATENT DOCUMENTS

| | | | | |
|---|---|---|---|---|
| 6,435,303 | B1 * | 8/2002 | Warnaka | 181/286 |
| 6,892,856 | B2 * | 5/2005 | Takahashi et al. | 181/293 |
| 8,251,175 | B1 | 8/2012 | Englert et al. | |
| 2005/0167193 | A1 * | 8/2005 | Van Reeth | 181/293 |
| 2006/0059801 | A1 * | 3/2006 | Allaei | 52/204.5 |
| 2010/0065369 | A1 * | 3/2010 | Honji | 181/293 |
| 2011/0278091 | A1 | 11/2011 | Honji et al. | |

FOREIGN PATENT DOCUMENTS

| | | | |
|---|---|---|---|
| JP | 2010-84509 | A | 4/2010 |
| JP | 2012-3226 | A | 1/2012 |

OTHER PUBLICATIONS

Japanese Office Action dated Nov. 11, 2014 with English-language translation (Four (4) pages).

* cited by examiner

*Primary Examiner* — Jeremy Luks
(74) *Attorney, Agent, or Firm* — Crowell & Moring LLP

(57) ABSTRACT

An acoustic structure, including a pipe having a plurality of cavities that are partitioned by a partition, each of the plurality of cavities extending in a first direction that is a longitudinal direction of the pipe, wherein the pipe has at least one opening which permits the plurality of cavities to communicate with an exterior of the pipe, a position of each of the at least one opening in the first direction being a first position.

8 Claims, 13 Drawing Sheets

RELATED ART

ACOUSTIC STRUCTURE

CROSS REFERENCE TO RELATED APPLICATION

The present application claims priority from Japanese Patent Application No. 2012-170553 filed on Jul. 31, 2012, the disclosure of which is herein incorporated by reference in its entirety.

BACKGROUND OF THE INVENTION

1. Field of the Invention

The present invention relates to an acoustic structure which prevents acoustic problems or troubles in an acoustic space and which adjusts sounds in the acoustic space to sounds that are pleasant to listen to.

2. Description of Related Art

In an acoustic space, such as an interior of a room, enclosed with walls, there may be caused acoustic troubles, such as booming and flutter echoes, by sounds that are repeatedly reflected between the walls opposed parallel to each other. The following Patent Literature 1 discloses a technique of preventing such acoustic troubles. FIG. 18 is a view for explaining an acoustic structure disclosed in the Patent Literature 1. The acoustic structure shown in FIG. 18 includes cavities 22-*i* (i=1 to 6) defined by plates 18, 19, 20, 21, 11-*i* (i=1 to 7), and openings 21-*i* (i=1 to 6) are formed in the front-side plate 18. The acoustic structure is installed on an inner wall or a ceiling of an acoustic space such that the openings 21-*i* (i=1 to 6) are oriented toward an inside of the acoustic space. When sounds enter the acoustic structure from the acoustic space, each of the cavities 22-*i* (i=1 to 6) of the acoustic structure resonates with a sound of a corresponding specific resonance frequency among sounds that enter the openings 21-*i* (i=1 to 6) from the acoustic space. The resonated sounds are emitted from the cavities 22-*i* (i=1 to 6) to the acoustic space through the respective openings 21-*i* (i=1 to 6), whereby sound scattering and sound absorbing effects are produced near the openings 21-*i* (i=1 to 6). As a result, it is possible to prevent the acoustic troubles such as booming and flutter echoes.

As shown in FIG. 18, in the acoustic structure disclosed in the Patent Literature 1, sound absorbing members 30-*i* (i=1 to 7) are attached to the front-side plate 18, whereby the sound scattering and sound absorbing effects produced near the openings are increased. In addition to the arrangement in which the sound absorbing members are attached to the front-side plate 18, the Patent Literature 1 further discloses an arrangement in which the cavities 22-*i* (i=1 to 6) are filled with the sound absorbing members.

Patent Literature 1: JP-A-2012-3226

SUMMARY OF THE INVENTION

In the meantime, it is required to reduce the thickness of the acoustic structure in view of easiness of installation of the acoustic structure to the acoustic space, and so on. Where the thickness of the acoustic structure is reduced, the cross-sectional area of the cavities 22-*i* (i=1 to 6) of the acoustic structure is reduced, undesirably causing a problem of insufficient sound scattering and sound absorbing effects. It is accordingly considered that the cross-sectional area of the cavities 22-*i* (i=1 to 6) is maintained at the same size by reducing the thickness of the cavities 22-*i* (i=1 to 6) and increasing the width of the cavities 22-*i* (i=1 to 6). Where the thickness of the cavities 22-*i* (i=1 to 6) is reduced and the width thereof is increased, however, the strength of the acoustic structure is lowered, causing a problem of deterioration in acoustic characteristics. In view of this, it is considered that the sound absorbing members are attached to the acoustic structure, as disclosed in the Patent Literature 1. In this case, however, a step of attaching the sound absorbing members to the acoustic structure is required, undesirably pushing up a manufacturing cost.

The present invention has been developed in view of the situations described above. It is therefore an object of the invention to provide an acoustic structure which enhances sound scattering and sound absorbing effects produced near an opening of an acoustic structure and which ensures the effects at a low cost.

The object indicted above may be attained according to a principle of the present invention, which provides 1. An acoustic structure, comprising a pipe having a plurality of cavities that are partitioned by a partition, each of the plurality of cavities extending in a first direction that is a longitudinal direction of the pipe, wherein the pipe has at least one opening which permits the plurality of cavities to communicate with an exterior of the pipe, a position of each of the at least one opening in the first position being a first position.

BRIEF DESCRIPTION OF DRAWINGS

The above and other objects, features, advantages and technical and industrial significance of the present invention will be better understood by reading the following detailed description of embodiments of the invention, when considered in connection with the accompanying drawings, in which.

DETAILED DESCRIPTION OF THE EMBODIMENTS

There will be described one embodiment of the present invention with reference to the drawings.

Embodiment

Figure 1A:
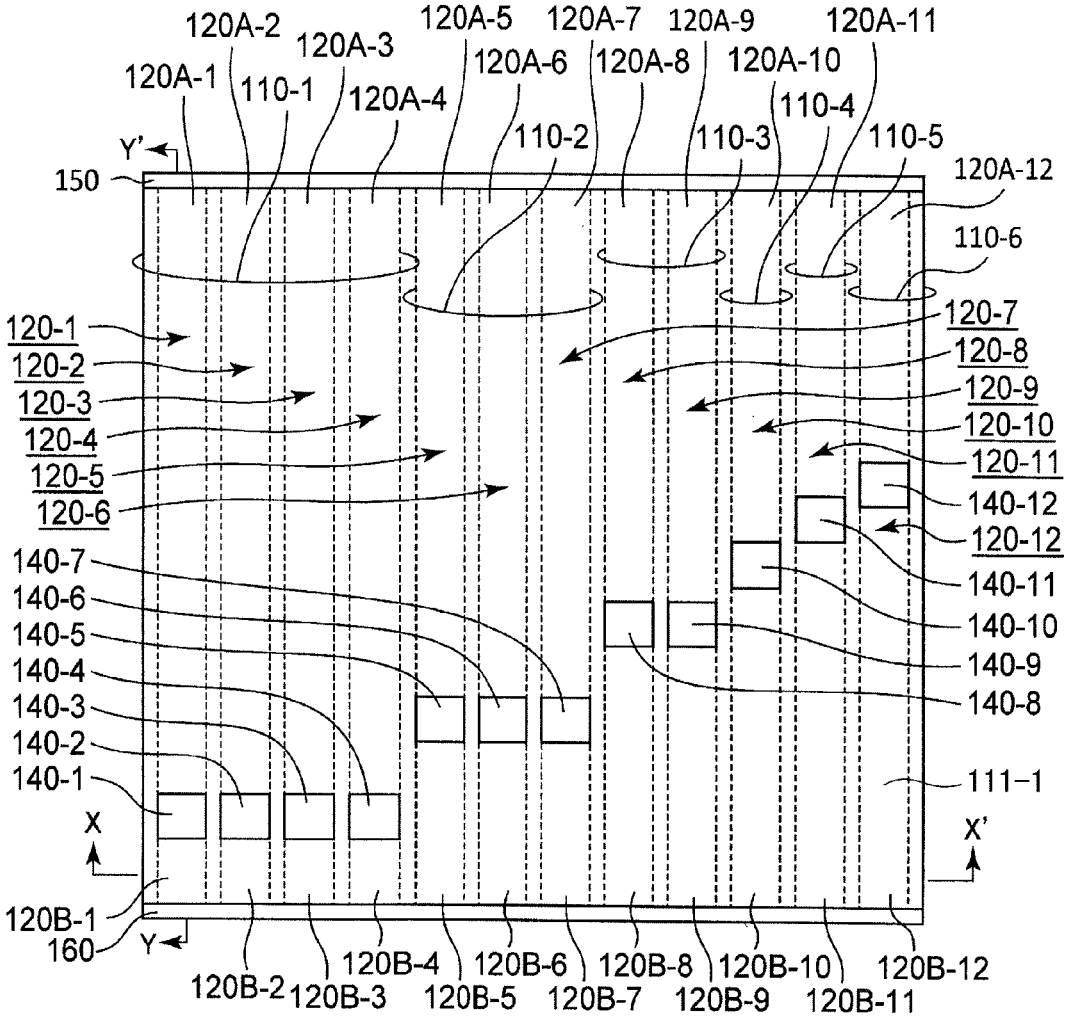
FIG. 1A is a front view and FIGS. 1B and 1C are cross-sectional views showing a configuration of an acoustic structure according to one embodiment of the present invention.
Figure 1B:
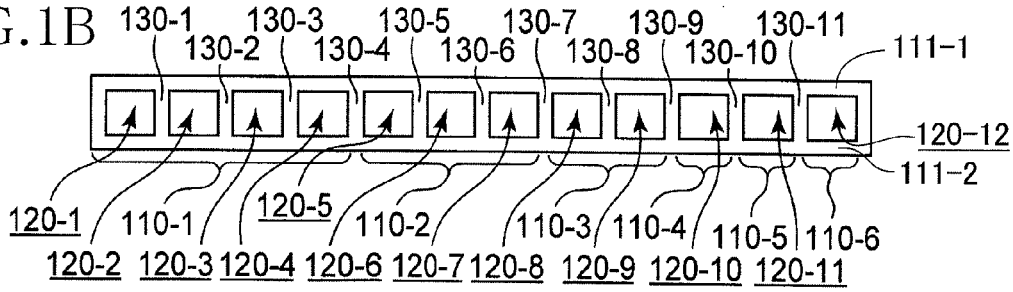
Figure 1C:
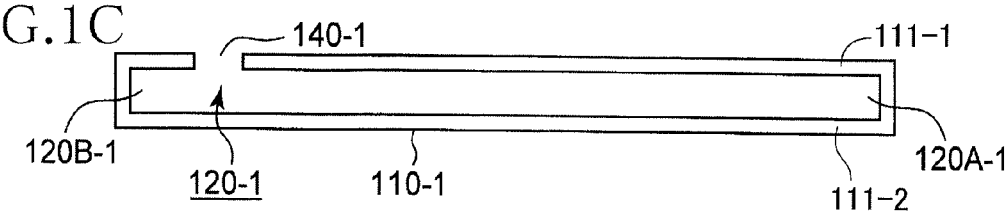

FIG. 1A is a front view showing an acoustic structure according to one embodiment of the invention. FIG. 1B is a cross-sectional view of the acoustic structure taken along line X-X'. FIG. 1C is a cross-sectional view of the acoustic structure taken along line Y-Y'. The acoustic structure is formed such that a plurality (n) number of pipes 110-*n* (n=1 to 6) are arranged side by side and are connected to each other in the form of a panel. In the acoustic structure of the present embodiment, a cross-sectional area of the pipe that ensures sufficient sound scattering and sound absorbing effects is ensured by reducing the thickness of each of the pipes 110-*n* (n=1 to 6) and by increasing the width thereof, and the strength of the acoustic structure is enhanced by providing, in the pipes each having a relatively large width, partitions by which a cavity or an interior of the pipe is partitioned in the width direction of the pipe. The width direction of the pipe corresponds to a cavity-arrangement direction in which cavities (that will be described) are arranged and is one example of a second direction).

In FIGS. 1A-1C, a pipe 110-1 (as one example of a pipe and one example of a first pipe) has four cavities 120-*m* (m=1 to 4) along the longitudinal direction of the pipe 110-1. The longitudinal direction of the pipe is a length direction of the pipe and is a direction in which the cavities extend (or the longitudinal direction of the cavities). Further, the longitudinal direction of the pipe is one example of a first direction. The cavities 120-*m* (m=1 to 4) are arranged in the width direction of the pipe 110-1 and are partitioned by partitions 130-*i* (i=1 to 3). A pipe 110-2 has three cavities 120-*m* (m=5 to 7) along the longitudinal direction of the pipe 110-2. The cavities 120-*m* (m=5 to 7) are arranged in the width direction of the pipe 110-2 and are partitioned by partitions 130-*i* (i=5 and 6). A pipe 110-3 has two cavities 120-*m* (m=8 and 9) along the longitudinal direction of the pipe 110-3. The cavities 120-*m* (m=8 and 9) are arranged in the width direction of the pipe 110-3 and are partitioned by partitions 130-8. A pipe 110-4 (as one example of a first pipe), a pipe 110-5, and a pipe 110-6 respectively have a cavity 120-10, a cavity 120-11, and a cavity 120-12. The cavities 120-*m* (m=1 to 4) of the pipe 110-1 have the same cross-sectional area taken along the plane perpendicular to the longitudinal direction of the pipe 110-1. The cavities 120-*m* (m=5 to 7) of the pipe 110-2 have the same cross-sectional area taken along the plane perpendicular to the longitudinal direction of the pipe 110-2. The cavities 120-*m* (m=8 and 9) of the pipe 110-3 have the same cross-sectional area taken along the plane perpendicular to the longitudinal direction of the pipe 110-3. The pipes 110-*n* (n=1 to 6) are formed by extrusion molding of synthetic resin, for instance. It is noted that the pipes 110-*n* (n=1 to 6) may be individually formed or may be integrally formed as one panel. Longitudinally opposite ends of each of the pipes 110-*n* (n=1 to 6) are closed by a plate 150 and a plate 160, respectively. In the present embodiment shown in FIG. 1, all of the cavities 120-*m* (m=1 to 12) of the pipes 110-*n* (n=1 to 6) may have the same cross-sectional area. A partition 130-4 is provided between the pipe 110-1 and the pipe 110-2. A partition 130-7 is provided between the pipe 110-2 and the pipe 110-3. A partition 130-9 is provided between the pipe 110-3 and the pipe 110-4. A partition 130-10 is provided between the pipe 110-4 and the pipe 110-5. A partition 130-11 is provided between the pipe 110-5 and the pipe 110-6.

On the front of the pipe 110-1, there are formed openings 140-*j* (j=1 to 4) that permit the corresponding cavities 120-*m* (m=1 to 4) of the pipe 110-1 to communicate with an exterior space of the pipe 110-1 (i.e., acoustic space). Accordingly, in the cavity 120-1, there are formed: a resonance pipe 120A-1 with the opening 140-1 as an open end and with the plate 150 as a closed end; and a resonance pipe 120B-1 with the opening 140-1 as an open end and with the plate 160 as the closed end. Similarly, resonance pipes 120A-2, 120B-2 are formed in the cavity 120-2, resonance pipes 120A-3, 120B-3 are formed in the cavity 120-3, and resonance pipes 120A-4, 120B-4 are formed in the cavity 120-4.

The openings 140-*j* (j=1 to 4) are formed at the same position (as one example of a first position) in the longitudinal direction of the pipe 110-1. Because the openings 140-*j* (j=1 to 4) are formed at the same position in the longitudinal direction of the pipe, the resonance pipes 120A-1 to 120A-4 have mutually the same length and the resonance pipes 120B-1 to 120B-4 have mutually the same length. Accordingly, the resonance pipes 120A-1 to 120A-4 have mutually the same resonance frequency, and the resonance pipes 120B-1 to 120B-4 have mutually the same resonance frequency. In other words, the pipe 110-1 has: a resonance pipe that has the same resonance frequency as the resonance pipe 120A-1 formed in the cavity 120-1 and that has a cross-sectional area four times as large as that of the resonance pipe 120A-1; and a resonance pipe that has the same resonance frequency as the resonance pipe 120B-1 formed in the cavity 120-1 and that has a cross-sectional area four times as large as that of the resonance pipe 120B-1.

On the front of the pipe 110-2, there are formed openings **140-*j* (j=5 to 7) that permit the corresponding cavities 120-*m* (m=5 to 7) of the pipe 110-2 to communicate with an exterior space of the pipe 110-2 (i.e., acoustic space). Accordingly, in the cavity 120-5, there are formed: a resonance pipe 120A-5 with the opening 140-5 as an open end and with the plate 150 as a closed end; and a resonance pipe 120B-5 with the opening 140-5 as an open end and with the plate 160 as a closed end. Similarly, resonance pipes 120A-6, 120B-6 are formed in the cavity 120-6, and resonance pipes 120A-7, 120B-7 are formed in the cavity 120-7**.

The openings **140-*j* (j=5 to 7) are formed at the same position in the longitudinal direction of the pipe 110-2. Because the openings 140-*j* (j=5 to 7) are formed at the same position in the longitudinal direction of the pipe, the resonance pipes 120A-5 to 120A-7 have mutually the same length and the resonance pipes 120B-5 to 120B-7 have mutually the same length. Accordingly, the resonance pipes 120A-5 to 120A-7 have mutually the same resonance frequency, and the resonance pipes 120B-5 to 120B-7 have mutually the same resonance frequency. In other words, the pipe 110-2 has: a resonance pipe that has the same resonance frequency as the resonance pipe 120A-5 formed in the cavity 120-5 and that has a cross-sectional area three times as large as that of the resonance pipe 120A-5; and a resonance pipe that has the same resonance frequency as the resonance pipe 120B-5 formed in the cavity 120-5 and that has a cross-sectional area three times as large as that of the resonance pipe 120B-5**.

On the front of the pipe 110-3, there are formed openings **140-*j* (j=8 to 9) that permit the corresponding cavities 120-*m* (m=8 to 9) of the pipe 110-3 to communicate with an exterior space of the pipe 110-3 (i.e., acoustic space). Accordingly, in the cavity 120-8, there are formed: a resonance pipe 120A-8 with the opening 140-8 as an open end and with the plate 150 as a closed end; and a resonance pipe 120B-8 with the opening 140-8 as the open end and with the plate 160 as a closed end. Similarly, the resonance pipes 120A-9, 120B-9 are formed in the cavity 120-9**.

The openings **140-*j* (j=8 and 9) are formed at the same position in the longitudinal direction of the pipe 110-3. Because the openings 140-*j* (j=8 and 9) are formed at the same position in the longitudinal direction of the pipe, the resonance pipes 120A-8, 120A-9 have mutually the same length and the resonance pipes 120B-8, 120B-9 have mutually the same length. Accordingly, the resonance pipes 120A-8, 120A-9 have mutually the same resonance frequency, and the resonance pipes 120B-8, 120B-9 have mutually the same resonance frequency. In other words, the pipe 110-3 has: a resonance pipe that has the same resonance frequency as the resonance pipe 120A-8 formed in the cavity 120-8 and that has a cross-sectional area twice as large as that of the resonance pipe 120A-8; and a resonance pipe that has the same resonance frequency as the resonance pipe 120B-8 and that has a cross-sectional area twice as large as that of the resonance pipe 120B-8**.

On the front of the pipe 110-4, there is formed an opening 140-10 that permits the cavity 120-10 of the pipe 110-4 to communicate with an exterior space of the pipe 110-4 (i.e., acoustic space). On the front of the pipe 110-5, there is formed an opening 140-11 that permits the cavity 120-11 of the pipe 110-5 to communicate with an exterior space of the pipe 110-5 (i.e., acoustic space). On the front of the pipe 110-6, there is formed an opening 140-12 that permits the cavity 120-12 of the pipe 110-6 to communicate with an exterior space of the pipe 110-6 (i.e., acoustic space). Accordingly, in the cavity 120-10, there is formed: a resonance pipe 120A-10 with the opening 140-10 as an open end and with the plate 150 as a closed end; and a resonance pipe 120B-10 with the opening 140-10 as an open end and with the plate 160 as a closed end. In the cavity 120-11, there are formed a resonance pipe 120A-11 with the opening 140-11 as an open end and with the plate 150 as a closed end; and a resonance pipe 120B-11 with the opening 140-11 as an open end and with the plate 160 as a closed end. In the cavity 120-12, there are formed: a resonance pipe 120A-12 with the opening 140-12 as an open end and with the plate 150 as a closed end; and a resonance pipe 120B-12 with the opening 140-12 as an open end and with the plate 160 as a closed end. For instance, where a part of each of the pipes **110-*n* (n=1 to 6) is defined by a flat plate portion 111-1 (as one example of a first flat plate portion) on the front side of the acoustic structure and a flat plate portion 111-2 (as one example of a second flat plate portion) on an opposite side of the front side, as shown in FIG. 1, the openings 140*j* (j=1 to 12) are formed in the flat plate portion 111-1. In other words, each of the plurality of cavities 120-*m* (m=1 to 12) is partially defined by the flat plate portion 111-1 and the flat plate portion 112-1 that are arranged in the thickness direction of the acoustic structure (as one example of a third direction) so as to be parallel to each other. The acoustic structure is installed in the acoustic space such that one of the two flat plate portions in which the openings 140-*j* (j=1 to 12) are formed, i.e., the flat plate portion 111-1, is disposed closer to the acoustic space. Further, the acoustic structure is installed in the acoustic space such that the longitudinal direction of the cavities and the cavity-arrangement direction in which the plurality of cavities are arranged are parallel to the wall or the ceiling of the acoustic space in which the acoustic structure is installed and such that the other of the two flat plate portions, i.e., the flat plate portion 111-2**, that is disposed more distant from the acoustic space is opposed to the wall or the ceiling of the acoustic space.

Here, where the resonance frequency of the resonance pipes 120A-1 to 120A-4 is f1, the resonance frequency of the resonance pipes 120A-5 to 120A-7 is f2, the resonance frequency of the resonance pipes 120A-8, 120A-9 is f3, and the resonance frequencies of the resonance pipes 120A-10, 120A-11, 120A-12 are f4, f5, f6, respectively, the following relationship is established: $f1<f2<f3<f4<f5<f6$. Thus, in the present embodiment, the lower the resonance frequency the resonance pipe has, the larger the number of the resonance pipes that are arranged in the width direction. As a result, a total cross-sectional area of a group of the resonance pipes having the same resonance frequency is increased as a whole. The configuration of the acoustic structure according to the present embodiment has been described hereinabove.

The acoustic structure according to the present embodiment is installed on an inner wall, a ceiling or the like of the acoustic space such that the front-side portion of the acoustic structure having the openings **140-*j* (j=1 to 12) is oriented toward an inside of the acoustic space. Where the acoustic structure is thus installed, the acoustic structure permits the sound energy radiated from the acoustic space toward the acoustic structure to be scattered near the openings 140-*j* (j=1 to 12) of the acoustic structure and permits sounds to be absorbed near the openings 140-*j*** (j=1 to 12).

More specifically, at the portion of the acoustic structure corresponding to the pipe 110-1, when the sound energy is radiated from the acoustic space toward the pipe 110-1, a part of the sound energy enters the cavities 120-1 to 120-4 via the corresponding openings 140-1 to 140-4. The sound energy entered in the cavity 120-1 resonates at the resonance frequencies of the respective resonance pipes 120A-1, 120B-1, so as to be radiated to the acoustic space via the corresponding opening 140-1. Similarly, the sound energy entered the cavity 120-2 resonates at the resonance frequencies of the respective resonance pipes 120A-2, 120B-2, the sound energy entered the cavity 120-3 resonates at the resonance frequencies of the respective resonance pipes 120A-3, 120B-3, and the sound energy entered the cavity 120-4 resonates at the resonance frequencies of the respective resonance pipes 120A-4, 120B-4, so as to be radiated to the acoustic space from the corresponding openings 140-2, 140-3, 140-4. As a result, the sound scattering and sound absorbing effects are produced near the openings 140-1 to 140-4. In the present embodiment, the openings 140-1 to 140-4 are located at the same position in the longitudinal direction of the pipe 110-1 so as to be adjacent or close to each other. According to the arrangement, because the resonance pipes 120A-1 to 120A-4 have mutually the same resonance frequency and the resonance pipes 120B-1 to 120B-4 have mutually the same resonance frequency, the sound scattering and sound absorbing effects respectively produced near the openings 140-1 to 140-4 have the same characteristics. Further, the sound scattering and sound absorbing effects respectively produced near the openings 140-1 to 140-4 are concentratedly produced. Accordingly, the pipe 110-1 having the openings 140-1 to 140-4 (the cavities 120-1 to 120-4) may be regarded as having a function similar to that of a pipe having one opening provided by the openings 140-1 to 140-4 (one cavity provided by the cavities 120-1 to 120-4). The sound scattering and sound absorbing effects produced near the openings 140-1 to 140-4 of the pipe are increased with an increase in the number of the openings (the number of the cavities).

As in the case of the pipe 110-1 explained above, at the portion of the acoustic structure corresponding to the pipe 110-2, the resonance pipes 120A-5 to 120A-7 have mutually the same resonance frequency, and the resonance pipes 120B-5 to 120B-7 have mutually the same resonance frequency. Further, the openings 140-5 to 140-7 are located at the same position in the longitudinal direction of the pipe 110-2 so as to be adjacent or close to each other. Accordingly, the sound scattering and sound absorbing effects having the same characteristics are concentratedly produced. Therefore, the pipe 110-2 having the openings 140-5 to 140-7 (the cavities 120-5 to 120-7) may be regarded as having a function similar to that of a pipe having one opening provided by the openings 140-5 to 140-7 (one cavity provided by the cavities 120-5 to 120-7). Similarly, at the portion of the acoustic structure corresponding to the pipe 110-3, the resonance pipes 120A-8, 120A-9 have mutually the same resonance frequency, and the resonance pipes 120B-8, 120B-9 have the mutually same resonance frequency. Further, the openings 140-8, 140-9 are located at the same position in the longitudinal direction of the pipe 110-3 so as to be adjacent or close to each other. Accordingly, the sound scattering and sound absorbing effects having the same characteristics are concentratedly produced. Therefore, the pipe 110-3 having the openings 140-8, 140-9 (the cavities 120-8, 120-9) may be regarded as having a function similar to that of a pipe having one opening provided by the openings 140-8, 140-9 (one cavity provided by the cavities 120-8, 120-9). Further, the sound scattering and sound absorbing effects produced near the openings 140-5 to 140-7 of the pipe 110-2 and the sound scattering and sound absorbing effects produced near the openings 140-8, 140-9 of the pipe 110-3 are also increased with an increase in the number of the openings (the number of the cavities).

In the acoustic structure according to the present embodiment, a plurality of cavities functioning as resonance pipes having mutually the same resonance frequency are formed, and the openings that permit the corresponding cavities to communicate with the exterior are disposed so as to be adjacent or close to each other, thereby increasing the sound scattering and sound absorbing effects produced near the openings.

In the acoustic structure according to the present embodiment, the cavity or the interior of the pipe is divided into a plurality of cavities, thereby making it possible to prevent a reduction in bending stiffness of the pipe wall, as explained below in detail. In a pipe in which a ratio of a dimension of the pipe wall in a direction perpendicular to the thickness direction of the cross section of the pipe with respect to a dimension of the cross section of the pipe in the thickness direction is large, the bending stiffness of the pipe wall is small. Where the bending stiffness of the pipe wall becomes small, the pipe tends to largely vibrate by the sound energy radiated from the acoustic space to the acoustic structure. Due to the vibration, the pipe cannot retain therein the sound corresponding to the resonance frequency of the pipe. The sound scattering and sound absorbing effects to be produced near the openings of the pipe are produced such that the sound energy entered the pipe is once retained in the pipe and resonated, and thereafter emitted through the openings. Accordingly, where the bending stiffness of the pipe wall becomes small, the sound scattering and sound absorbing effects are decreased. Further, the pipe corresponding to a lower resonance frequency requires a higher degree of bending stiffness to retain therein the sound at a lower resonance frequency. Here, where the outside dimension of the pipe is constant, the bending stiffness of the pipe wall is small when the cavity of the pipe is not divided into a plurality of cavities while the bending stiffness of the pipe is not small when the cavity of the pipe is divided into a plurality of cavities since the pipe has the partitions therein that function as beams or support members to resist a stress.

Thus, in the acoustic structure according to the present embodiment, the cavity of the pipe is divided into a plurality of cavities by the partitions, thereby preventing a reduction in the bending stiffness of the pipe wall. Further, it is possible to prevent the sound scattering and sound absorbing effects to be produced near the openings of the pipe from being lowered due to a reduction in the bending stiffness of the pipe wall. It is noted that the advantage is larger in the pipe corresponding to a lower resonance frequency.

Figure 2:
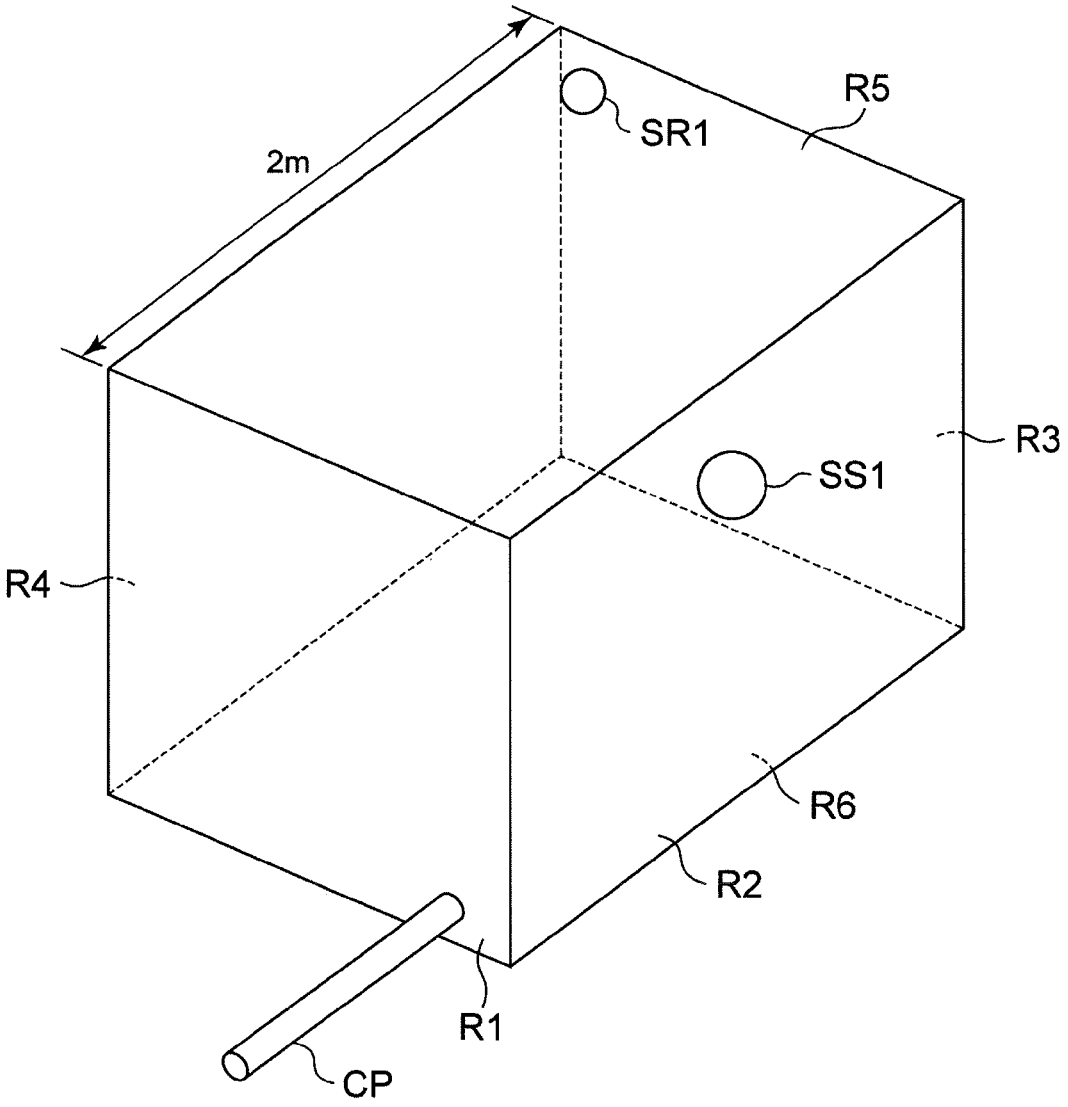
FIG. 2 is a view for explaining an experiment in which a cylindrical pipe resonator/resonators is/are installed in an acoustic space and in which frequency characteristics of a sound-pressure level at a sound receiving point is measured when a test sound is generated from a sound source.

Next, the inventors conducted the following experiment. That is, a cylindrical pipe resonator is installed in an acoustic space, and there are measured frequency characteristics of a sound-pressure level at a sound receiving point when a test sound was generated from a sound source. FIG. 2 is a view for explaining an experiment system for the experiment. The acoustic space enclosed with plates R1 to R6 is a known sound field. A sound source SS1 is disposed in the acoustic space at a position that is a lower central position of the plate R3 and is adjacent to the plate R3. Further, a microphone is disposed at a position that is upper left corner position of the plate R3 and is adjacent to the plate R3, so as to provide a sound receiving point SR1. A cylindrical pipe resonator CP is installed at a lower right corner position of the plate R1 that is opposed to and is distant by 2 meters from the plate R3 defining the sound source SS1 and the sound receiving point SR1. One end of the pipe resonator CP is open while the other end thereof is closed. The open end of the pipe resonator CP is connected to the plate R1, and a cavity of the pipe resonator CP is held in communication with the acoustic space via the open end of the pipe resonator CP. A test sound with a varying frequency is generated from the sound source SS1, and the sound-pressure level of the test sound is measured at the sound receiving point SR1.

Figure 4:
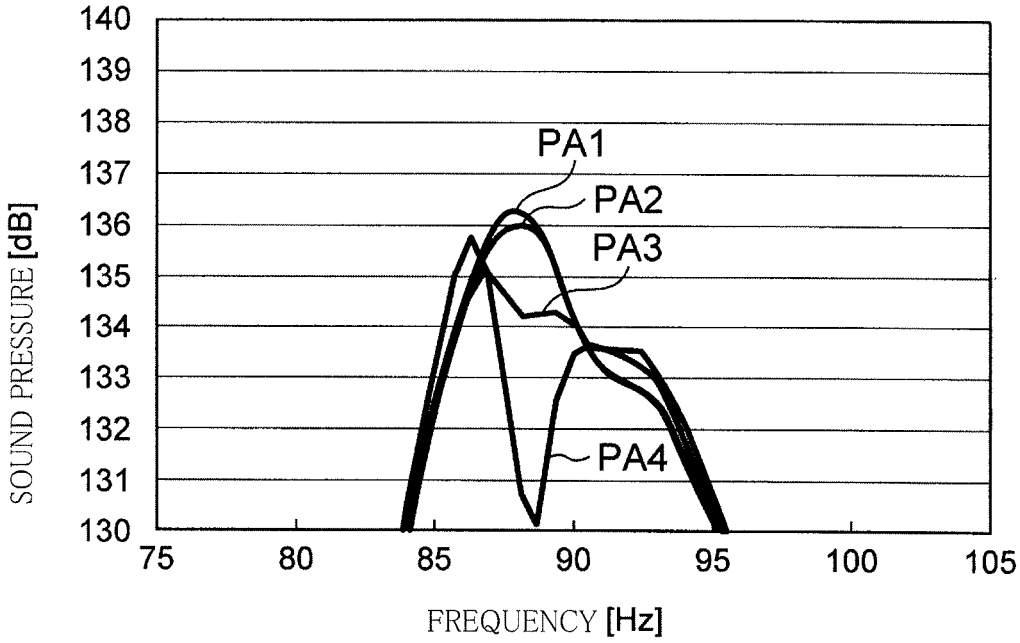
FIG. 4 is a graph showing an influence of a size of a cross-sectional area of a cavity of a pipe resonator on acoustic characteristics of the acoustic space.

In this experiment system, there is initially measured a sound-pressure level in an instance where the pipe resonator CP is not installed in the acoustic space. Subsequently, there are measured the sound-pressure level in an instance where one cylindrical pipe resonator CP having the inside diameter of 13 mm is installed in the acoustic space, the sound-pressure level in an instance where one cylindrical pipe resonator CP having the inside diameter of 30 mm is installed in the acoustic space, and the sound-pressure level an instance where one cylindrical pipe resonator CP having the inside diameter of 50 mm is installed in the acoustic space. In this instance, the length (the pipe length) of each pipe resonator CP is about 960 mm. Fine adjustment of the pipe length is conducted in accordance with a frequency in a longitudinal mode, namely, in accordance with a frequency in a mode in a longitudinal direction from the plate R3 to the plate R1 in the acoustic space. FIG. 4 is a graph showing results of the measurement, namely, a sound-pressure peak in a first mode of a longitudinal axial wave in the acoustic space. In the graph of FIG. 4, the horizontal axis indicates sound frequency while the vertical axis indicates sound-pressure level. In FIG. 4, a measurement result of the sound-pressure level in the instance where the pipe resonator CP is not installed is indicated by PA1. Further, a measurement result of the sound-pressure level obtained when the pipe resonator CP having the inside diameter 13 mm is installed is indicated by PA2, a measurement result of the sound-pressure level obtained when the pipe resonator CP having the inside diameter 30 mm is installed is indicated by PA3, and a measurement result of the sound-pressure level obtained when the pipe resonator CP having the inside diameter 50 mm is installed is indicated by PA4.

As shown in FIG. 4, the sound-pressure peak in the first mode of the longitudinal axial wave emerges at about 88 Hz when the pipe resonator CP is not installed. The sound-pressure peak at the frequency of about 88 Hz becomes lower with an increase in the inside diameter of the pipe resonator CP (from 13 mm, to 30 mm, and finally to 50 mm). This indicates that an influence exerted by the pipe resonator CP on the acoustic space (i.e., the sound scattering and sound absorbing effects produced near the open end of the pipe resonator CP) becomes larger with an increase in the inside diameter of the pipe resonator CP installed in the acoustic space, namely, with an increase in the cross-sectional area of the cavity of the pipe resonator CP.

Figures 3A, 3B, 3C:
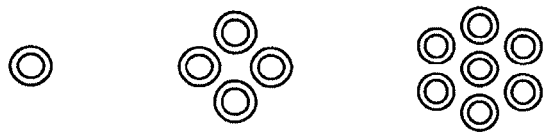
FIGS. 3A-3C are views each showing a cross section of a pipe resonator/resonators CP on an installation surface thereof when installed in the acoustic space shown in FIG. 2.
Figure 5:
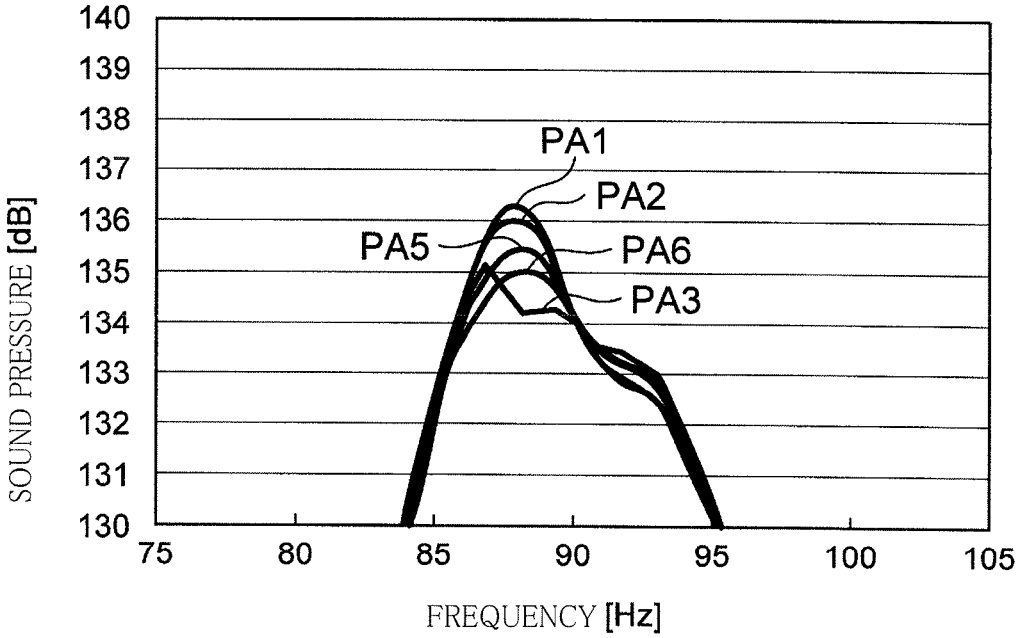
FIG. 5 is a graph showing an influence of a number of the pipe resonators on acoustic characteristics of the acoustic space.

Next, in the experiment system shown in FIG. 2, the sound-pressure level is measured when a plurality of pipe resonators CP are concentratedly installed, in other words, when a plurality of pipe resonators are installed so as to be adjacent and close to one another. More specifically, there are measured the sound-pressure level in an instance where one cylindrical pipe resonator CP having the inside diameter of 13 mm is installed on the plate R1 of the acoustic space so as to have the cross section shown in FIG. 3A, the sound-pressure level in an instance where four cylindrical pipe resonators CP having the inside diameter of 13 mm are concentratedly installed on the plate R1 of the acoustic space so as to have the cross section shown in FIG. 3B, and the sound-pressure level in an instance in which seven cylindrical pipe resonators CP having the inside diameter of 13 mm are concentratedly installed on the plate R1 of the acoustic space so as to have the cross section shown in FIG. 3C. FIG. 5 is a graph showing results of the measurement, namely, a sound-pressure peak in the first mode of the longitudinal axial wave in the acoustic space. In the graph of FIG. 5, the horizontal axis indicates sound frequency while the vertical axis indicates sound-pressure level. In FIG. 5, a measurement result of the sound-pressure level obtained when one pipe resonator CP having the inside diameter of 13 mm is installed is indicated by PA2, a measurement result of the sound-pressure level obtained when four pipe resonators CP having the inside diameter of 13 mm is installed is indicated by PA5, and a measurement result of the sound-pressure level obtained when seven pipe resonators CP having the inside diameter of 13 mm is installed is indicated by PA6. In FIG. 5, there are also indicated the measurement result PA1 of the sound-pressure level obtained when the pipe resonator CP is not installed and the measurement result PA3 of the sound-pressure level obtained when one pipe resonator CP having the inside diameter of 30 mm is installed.

As shown in FIG. 5, at the frequency of about 88 Hz at which a sound-pressure peak in the first mode of the longitudinal axial wave emerges when the pipe resonator CP is not installed, the sound-pressure peak becomes lower with an increase in the number of the pipe resonators CP having the inside diameter of 13 mm (from one, to four, and finally to seven). This indicates that an influence exerted by the pipe resonator CP on the acoustic space (i.e., the sound scattering and sound absorbing effects produced near the open end of the pipe resonator CP) becomes larger with an increase in the number of the pipe resonators CP installed in the acoustic space (i.e., the total cross-sectional area of the cavities of the pipe resonator CP).

Further, as shown in FIG. 4, it is indicated that the influence on the acoustic space is small where the inside diameter of the pipe resonator CP is small, namely, where the cross-sectional area of the cavity of the pipe resonator CP is small. As shown in FIG. 5, by concentratedly installing the pipe resonator CP having the small inside diameter in a plural number, it is possible to increase the influence exerted by the pipe resonators CP on the acoustic space even if the inside diameter (the cross-sectional area of the cavity) of each pipe resonators CP is small.

Figures 7A, 7B, 7C, 7D:
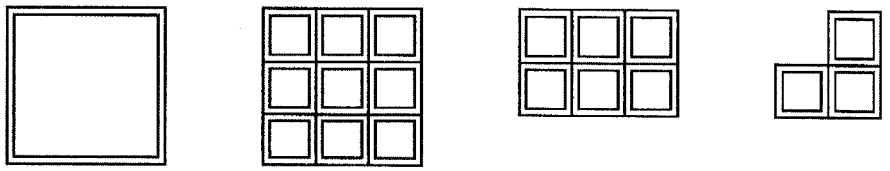
FIGS. 7A-7D are views each showing a cross section of a pipe resonator/resonators AP on an installation surface thereof when installed in the acoustic space shown in FIG. 6.

Next, the inventors confirmed an influence exerted by the pipe resonator on the acoustic space in an instance where the cavity of the pipe resonator installed in the acoustic space is not divided and in an instance where the cavity of pipe resonator installed in the acoustic space is divided into a plurality of cavities. More specifically, there are measured frequency characteristics of the sound-pressure level in an instance where one square pipe resonator having a cavity whose cross-sectional shape is a square with one side 45 mm in length as shown in FIG. 7A is installed in the acoustic space, frequency characteristics of the sound-pressure level in an instance where nine square pipe resonators each having a cavity whose cross-sectional shape is a square with one side 15 mm in length are concentratedly installed in the acoustic space as shown in FIG. 7B. The cross-sectional area of the cavity of the square pipe resonator having the cavity whose cross-sectional shape is the square with one side 45 mm in length is equal to the total cross-sectional area of the cavities of the nine square pipe resonators each having the cavity whose cross-sectional shape is the square with one side 15 mm in length. By concentratedly installing the nine square pipe resonators each having the cavity whose cross-sectional shape is the square with one side 1.5 mm in length, there is established a state similar to a state in which the interior of the square pipe resonator having the cavity whose cross-sectional shape is the square with one side 45 mm in length is divided into nine cavities each having the square cross-sectional shape with one side 15 mm in length. In this way, the influence exerted by the pipe resonator on the acoustic space in the instance in which the cavity is divided into a plurality of cavities is confirmed.

Figure 6:
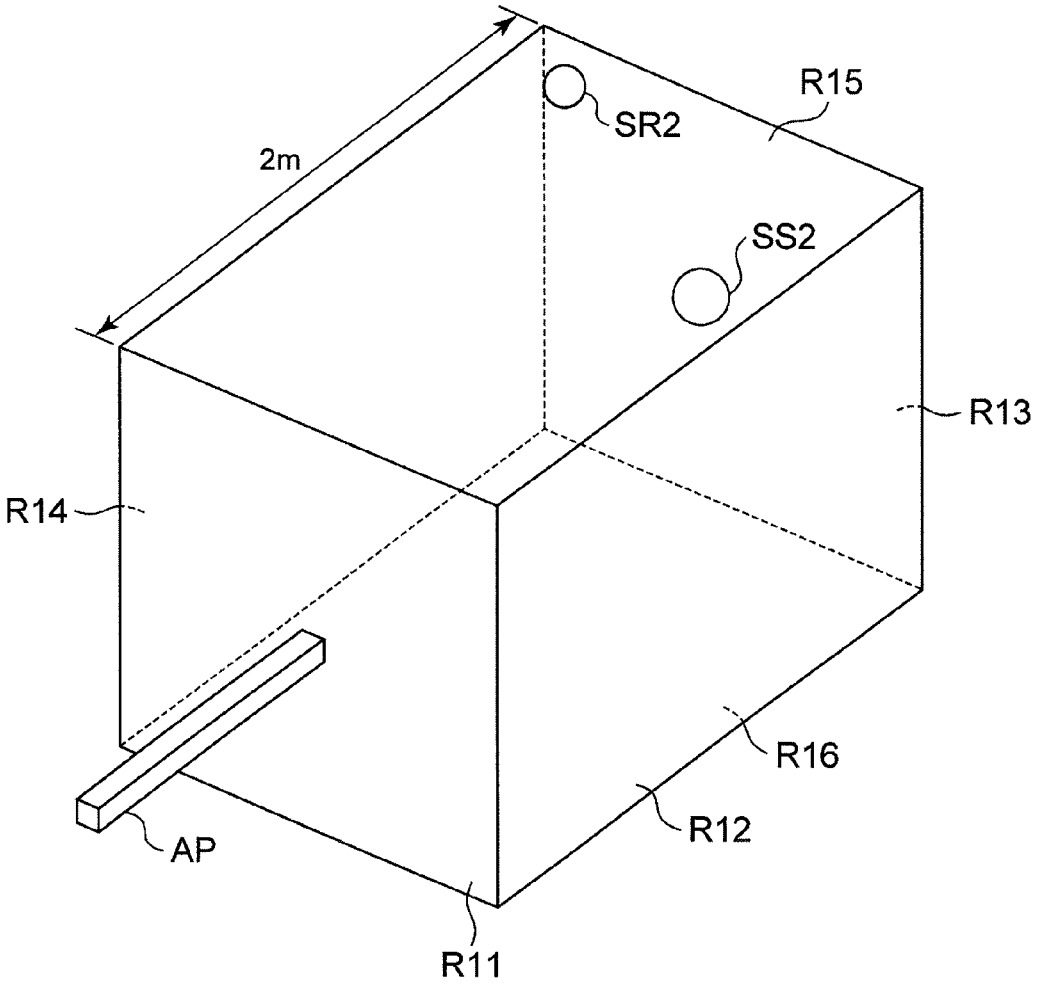
FIG. 6 is a view for explaining an experiment for confirming an influence on an acoustic space exerted by a pipe resonator installed in the acoustic space in a case in which a cavity of the pipe resonator is not partitioned and in a case in which the cavity of the pipe resonator is partitioned into a plurality of cavities.

FIG. 6 is a view for explaining an experiment system of the experiment. An acoustic space enclosed with plates R11 to R16 is a known sound field. A sound source SS2 is disposed in the acoustic space at a position that is a central position of the plate R13 and is adjacent to the plate R3. Further, a microphone is disposed at a position that is an upper left corner position of the plate R3 and is adjacent to the plate R3, so as to provide a sound receiving point SR2. A square pipe resonator AP is installed at a central position of the plate R11 that is opposed to and is distant from by 2 meters from the plate R13 that defines the sound source SS2 and the sound receiving point SR2. One end of the pipe resonator AP is open while the other end thereof is closed. The open end of the pipe resonator AP is connected to the plate R11, and the cavity of the pipe resonator AP is held in communication with the acoustic space via the open end of the pipe resonator AP. A test sound with a varying frequency is generated from the sound source SS2, and the sound-pressure level of the test sound is measured at the sound receiving point SR2.

Figure 8:
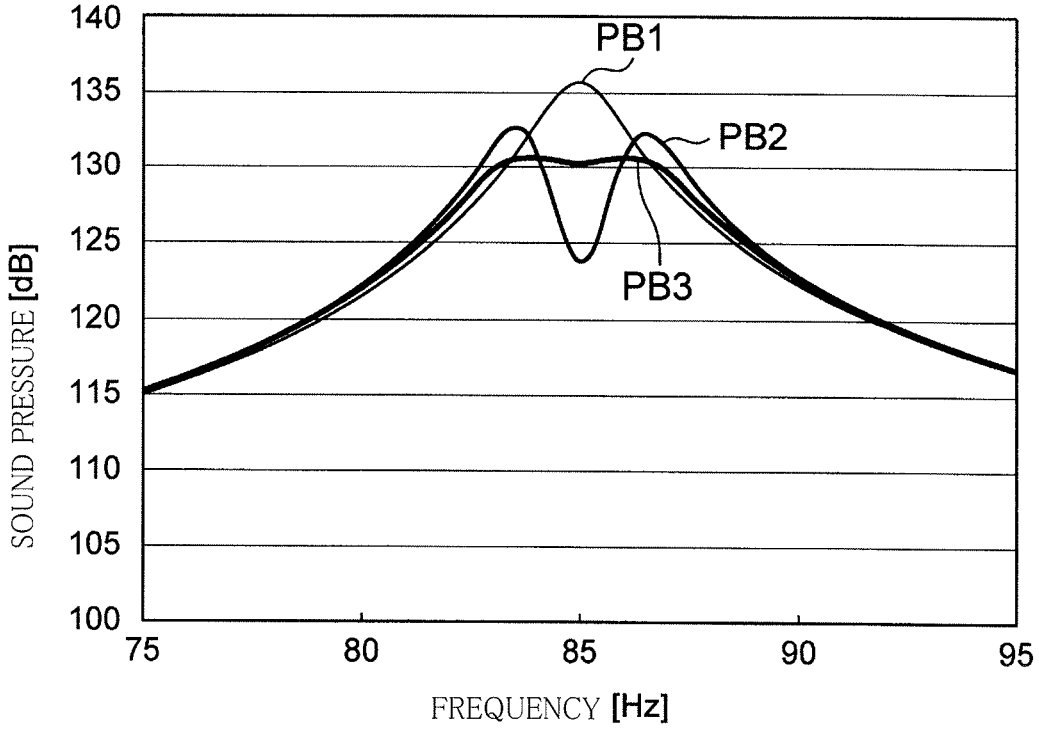
FIG. 8 is a graph showing the acoustic characteristics of the acoustic space when a cross-sectional area of the cavity in the case in which the cavity of the pipe resonator is not partitioned is made equal to a total cross-sectional area of a plurality of cavities in the case in which the cavity of the pipe resonator is partitioned into the plurality of cavities.

In this experiment system, there is initially measured the sound-pressure level in an instance where the pipe resonator AP is not installed. Subsequently, one square pipe resonator AP having a cavity whose cross-sectional shape is a square with one side 45 mm in length is installed in the acoustic space, and the sound-pressure level is measured. Thereafter, in place of the square pipe resonator AP having the cavity whose cross-sectional shape is the square with one side 45 mm in length, nine square pipe resonators AP each having a cavity whose cross-sectional shape is a square with one side 15 mm in length are installed in the acoustic space, and the sound-pressure level is measured. FIG. 8 is a graph showing results of the measurement, namely, a sound-pressure peak in the first mode of the longitudinal axial wave in the acoustic space. In the graph of FIG. 8, the horizontal axis indicates sound frequency while the vertical axis indicates sound-pressure level. In FIG. 8, the measurement result of the sound-pressure level obtained when the pipe resonator AP is not installed is indicated by PB1, the measurement result of the sound-pressure level obtained when one square pipe resonator having the cavity whose cross-sectional shape is the square with one side 45 mm in length is installed is indicated by PB2, and the measurement result of the sound-pressure level obtained when the nine square pipe resonators AP each having the cavity whose cross-sectional shape is the square with one side 15 mm in length are installed is indicated by PB3.

As shown in FIG. 8, the sound-pressure level in the instance where one square pipe resonator AP having the cavity whose cross-sectional shape is the square with one side 45 mm in length is installed is reduced by about 10 dB at the frequency of about 85 Hz at which the sound-pressure peak emerges in the first mode of the longitudinal axial wave in the acoustic space when the pipe resonator AP is not installed. However, the sound-pressure peak remains each at the frequency of about 84 Hz and the frequency of about 86 Hz that are around the frequency of about 85 Hz at which the sound-pressure peak emerges. Accordingly, a sound-pressure-peak reduction amount from the sound-pressure peak (at about 85 Hz) in the instance where the pipe resonator AP is not installed to the remaining sound-pressure peaks (at about 84 Hz and about 86 Hz) is about 3 dB. On the other hand, in the sound-pressure level in the instance where the nine square pipe resonators AP each having the cavity whose cross-sectional shape is the square with one side 15 mm in length are installed, the sound-pressure peak does not remain over the frequencies (from about 84 Hz to about 86 Hz) that are around the sound-pressure peak in the instance where the pipe resonator AP is not installed, and the sound-pressure level is reduced by about 5 dB at the frequencies around the sound-pressure peak. This indicates that when the cross-sectional area of the cavity in the instance where the cavity is not divided is equal to the total cross-sectional area of a plurality of cavities in the instance where the cavity is divided into the plurality of cavities, the reduction effect of the sound-pressure peak is larger in the instance where the cavity is divided into the plurality of cavities than in the instance where the cavity is not divided. In other words, the influence exerted by the pipe resonator AP on the acoustic space is larger and the sound scattering and sound absorbing effects produced near the open end of the pipe resonator are larger in the instance where the cavity of the pipe resonator AP is divided into the plurality of cavities than in the instance where the cavity is not divided.

The results shown in FIGS. 4, 5, and 8 indicate the following. That is, in the acoustic structure according to the present embodiment, the cavity of the pipe is divided into a plurality of cavities, so that the cross-sectional area of one cavity becomes small. Nevertheless, since the openings that permit the corresponding cavities to communicate with the exterior are disposed so as to be adjacent or close to each other, it is possible to enhance the sound scattering and sound absorbing effects near the openings. Where the cavity of the pipe is divided such that the cross-sectional area of the cavity before divided is equal to the total cross-sectional area of the cavities after divided, the sound scattering and sound absorbing effects can be enhanced when the cavity of the pipe is divided into a plurality of cavities than when the cavity of the pipe is not divided.

Figure 9A:
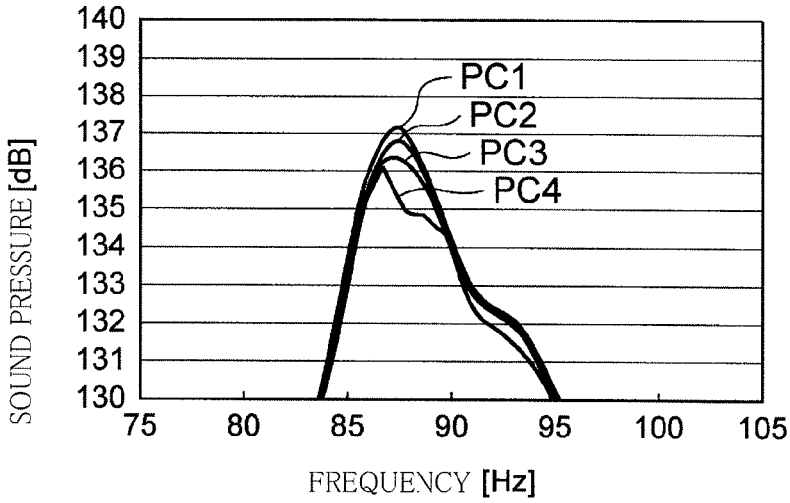
FIGS. 9A-9C are graphs each showing an influence of a size of a cross-sectional area of a cavity of a pipe resonator on acoustic characteristics of the acoustic space, in various frequency bands of a sound emitted to a pipe resonator.
Figure 9B:
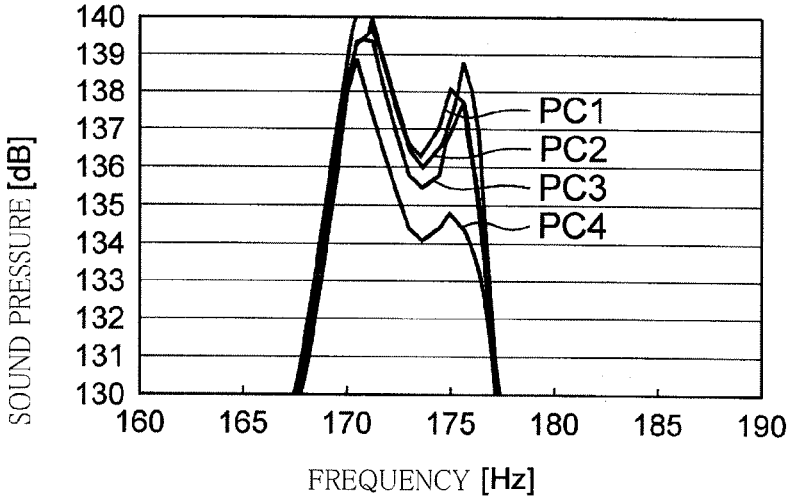
Figure 9C:
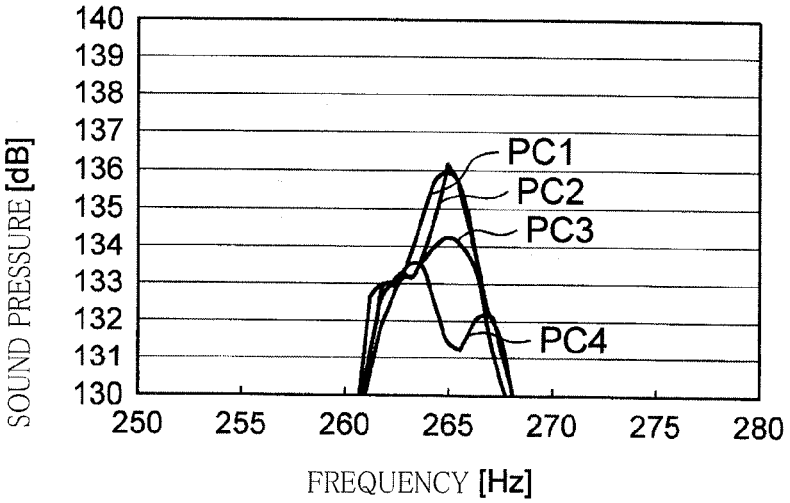

Next, the inventors confirmed by the following experiment an influence of the cross-sectional area of the cavity of the pipe resonator on acoustic characteristics of the acoustic space, in various frequency bands of a sound emitted to the pipe resonator. In the experiment of FIG. 2 illustrated above, the sound-pressure level in the first mode of the longitudinal axial wave in the acoustic space was measured. In the present experiment, the sound-pressure level is measured, using the same experiment system as in FIG. 2, in a frequency band of a second mode and a frequency band of a third mode of the longitudinal axial wave in the acoustic space, in addition to the first mode of the longitudinal axial wave. More specifically, in the experiment system shown in FIG. 2, the sound-pressure level in the frequency band of the first mode (about 88 Hz), the frequency band of the second mode (about 175 Hz), and the frequency band of the third mode (about 265 Hz) of the longitudinal axial wave in the acoustic space is measured in the following instances: an instance in which the pipe resonator CP is not installed in the acoustic space; an instance in which one cylindrical pipe resonator CP having an inside diameter of 13 mm is installed in the acoustic space; an instance in which one cylindrical pipe resonator CP having an inside diameter of 20 mm is installed in the acoustic space; an instance in which one cylindrical pipe resonator CP having an inside diameter of 30 mm is installed in the acoustic space. FIG. 9A is a graph showing a measurement result of the first mode in the experiment, FIG. 9B is a graph showing a measurement result in the second mode of the experiment, and FIG. 9C is a graph showing a measurement result in the third mode. In each of FIGS. 9A-9C, the horizontal axis indicates sound frequency while the vertical axis indicates sound-pressure level. In each of FIGS. 9A-9C, the measurement result obtained when the pipe resonator CP is not installed is indicated by PC1, the measurement result obtained when the pipe resonator CP having the inside diameter of 13 mm is installed is indicated by PC2, the measurement result obtained when the pipe resonator CP having the inside diameter of 20 mm is installed is indicated by PC3, and the measurement result obtained when the pipe resonator CP having the inside diameter of 30 mm is installed is indicated by PC4.

In FIGS. 9A-9C, the measurement result PC4 obtained when the pipe resonator CP having the inside diameter of 30 mm is installed is focused. As shown in FIG. 9A, the sound-pressure peak in the first mode (about 88 Hz) of the longitudinal axial wave in the instance where the pipe resonator CP is not installed is about 137 dB, and the sound-pressure peak in the first mode (about 88 Hz) of the longitudinal axial wave in the instance where the pipe resonator CP having the inside diameter of 30 mm is installed is about 135 dB. Accordingly, a sound-pressure-peak reduction amount in the first mode (about 88 Hz) of the longitudinal axial wave in the instance where the pipe resonator CP having the inside diameter of 30 mm is installed is about 2 dB. Further, as shown in FIG. 9B, the sound-pressure peak in the second mode (about 175 Hz) of the longitudinal axial wave in the instance where the pipe resonator CP is not installed is about 138 dB, and the sound-pressure peak in the second mode (about 175 Hz) of the longitudinal axial wave in the instance where the pipe resonator CP having the inside diameter of 30 mm is installed is about 135 dB. Accordingly, a sound-pressure-peak reduction amount in the second mode of the longitudinal axial wave (about 175 Hz) in the instance where the pipe resonator CP having the inside diameter of 30 mm is installed is about 3 dB. Further, as shown in FIG. 9C, the sound-pressure peak in the third mode (about 265 Hz) of the longitudinal axial wave in the instance where the pipe resonator CP is not installed is about 136 dB, and the sound-pressure peak in the third mode (about 265 Hz) of the longitudinal axial wave in the instance where the pipe resonator CP having the inside diameter of 30 mm is installed is about 131.5 dB. Accordingly, a sound-pressure-peak reduction amount in the third mode (about 265 Hz) of the longitudinal axial wave in the instance where the pipe resonator CP having the inside diameter of 30 mm is installed is about 4.5 dB.

Thus, where the inside diameter, namely, the cross-sectional area of the cavity, of the pipe resonator CP installed in the acoustic space is constant, the higher the mode of the longitudinal axial wave in the acoustic space, namely, the higher the frequency of the sound, the larger the sound-pressure-peak reduction amount. In other words, the influence of the pipe resonator CP on the acoustic space is increased, namely, the sound scattering and sound absorbing effects produced near the open end of the pipe resonator CP are enhanced, with an increase in the frequency of the sound emitted to the pipe resonator CP.

Figure 10:
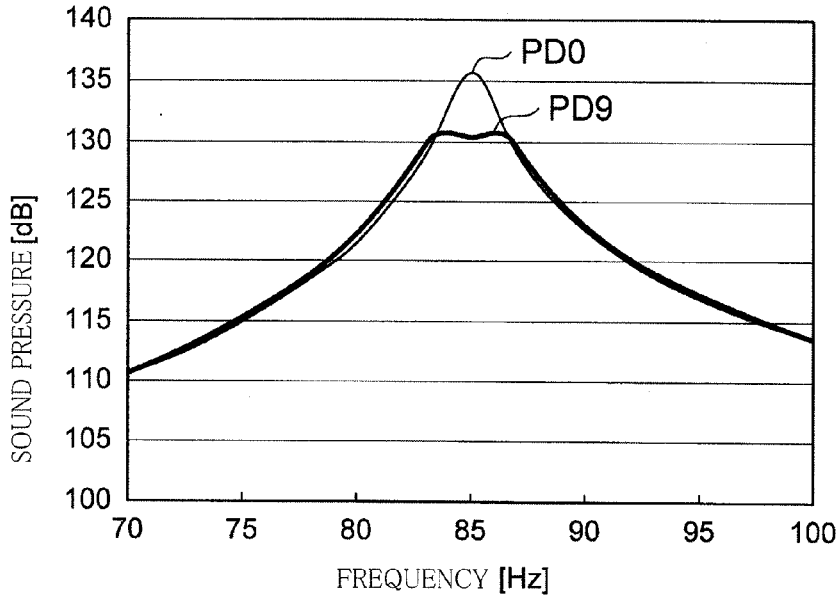
FIG. 10 is a graph showing a relationship between a frequency band of a first mode of a longitudinal axial wave and a total cross-sectional area of cavities of the pipe resonator required for the pipe resonator to exert an influence on the acoustic space.
Figure 11:
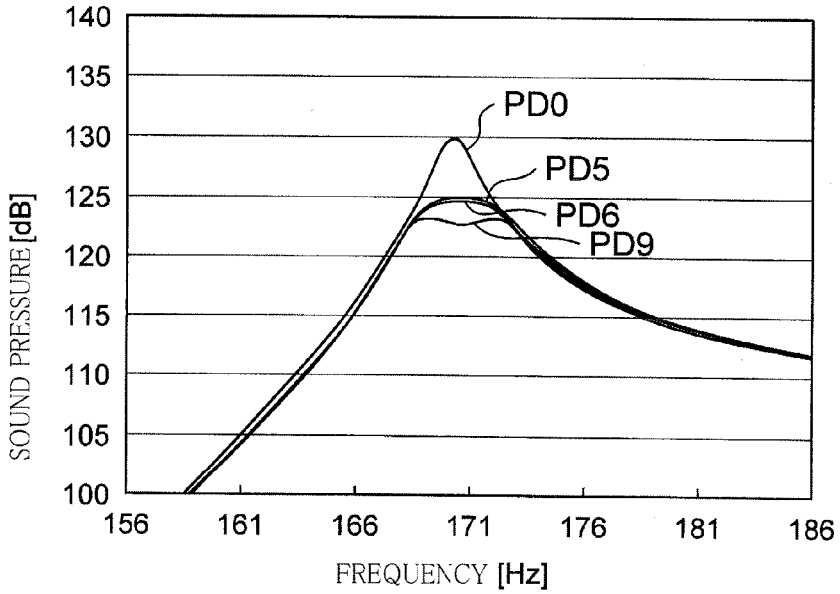
FIG. 11 is a graph showing a relationship between a frequency band of a second mode of the longitudinal axial wave and a total cross-sectional area of cavities of the pipe resonator required for the pipe resonator to exert an influence on the acoustic space.
Figure 12:
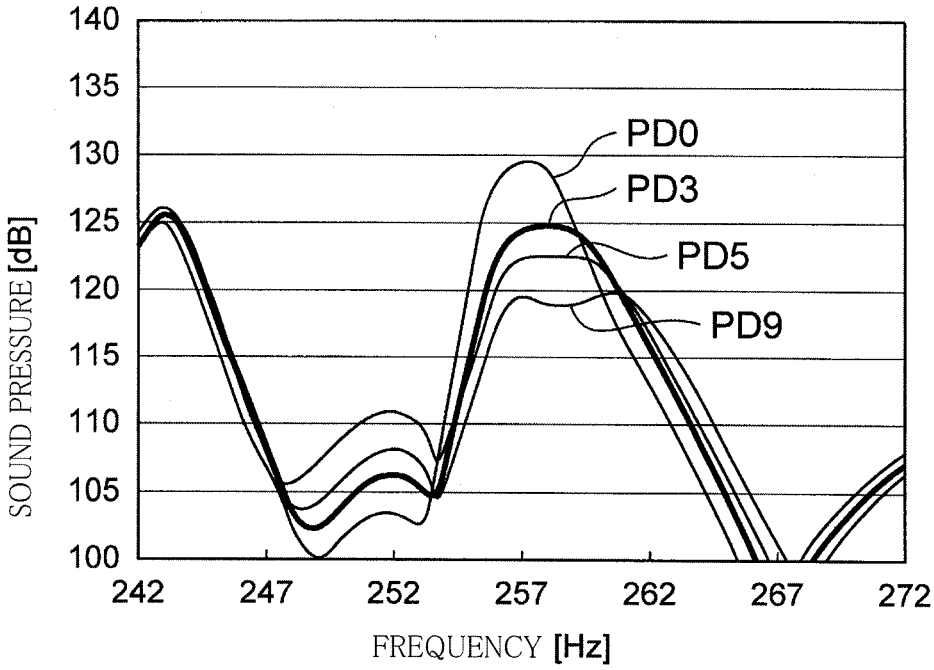
FIG. 12 is a graph showing a relationship between a frequency band of a third mode of the longitudinal axial wave and a total cross-sectional area of cavities of the pipe resonator required for the pipe resonator to exert an influence on the acoustic space.

Next, the inventors confirmed a relationship between each frequency band of the sound emitted to the pipe resonator and the total cross-sectional area of cavities of the pipe resonator required for the pipe resonator to exert an influence on the acoustic space. The following experiment was conducted using the same experiment system as in FIG. 6. In the experiment, there are installed, in the acoustic space, different numbers of the square pipe resonator AP having the cavity whose cross-sectional shape is the square with one side 15 mm in length, and the sound-pressure level is measured in the frequency band of the first mode (85 Hz), the frequency band of the second mode (171 Hz), and the frequency band of the third mode (257 Hz) of the longitudinal axial wave in the acoustic space. FIG. 10 is a graph showing a measurement result of the experiment in the first mode, FIG. 11 is a measurement result of the experiment in the second mode, and FIG. 12 is a measurement result of the experiment in the third mode. In each of FIGS. 10-12, the horizontal axis indicates sound frequency while the vertical axis indicates sound-pressure level. In each of FIGS. 10-12, the measurement result of the sound-pressure level obtained when the pipe resonator AP is not installed is indicated by PD0. Further, the measurement results of the sound-pressure level obtained when nine square pipe resonators AP, six square pipe resonators AP, five square pipe resonators AP, and three square pipe resonators AP are installed are indicated by PD9, PD6, PD5, and PD3, respectively. Each square pipe resonator AP has the cavity whose cross-sectional shape is the square with one side 15 mm in length.

As shown in FIG. 10, a reduction amount of the sound-pressure peak in the first mode of the longitudinal axial wave in the instance where the nine square pipe resonators AP each having the cavity whose cross-sectional shape is the square with one side 15 mm are concentratedly installed as shown in FIG. 7B, with respect to the sound-pressure peak in the instance where the pipe resonator AP is not installed, is about 5 dB. Further, as shown in FIG. 11, a reduction amount of the sound-pressure peak in the second mode of the longitudinal axial wave in the instance where the six square pipe resonators AP each having the cavity whose cross-sectional shape is the square with one side 15 mm are concentratedly installed as shown in FIG. 7C, with respect the sound-pressure peak when the pipe resonator AP is not installed, is about 5 dB. Further, as shown in FIG. 12, a reduction amount of the sound-pressure peak in the third mode of the longitudinal axial wave in the instance where the three square pipe resonators AP each having the cavity whose cross-sectional shape is the square with one side 15 mm are concentratedly installed as shown in FIG. 7D, with respect the sound-pressure peak in the instance where the pipe resonator AP is not installed, is about 5 dB.

Figure 13:
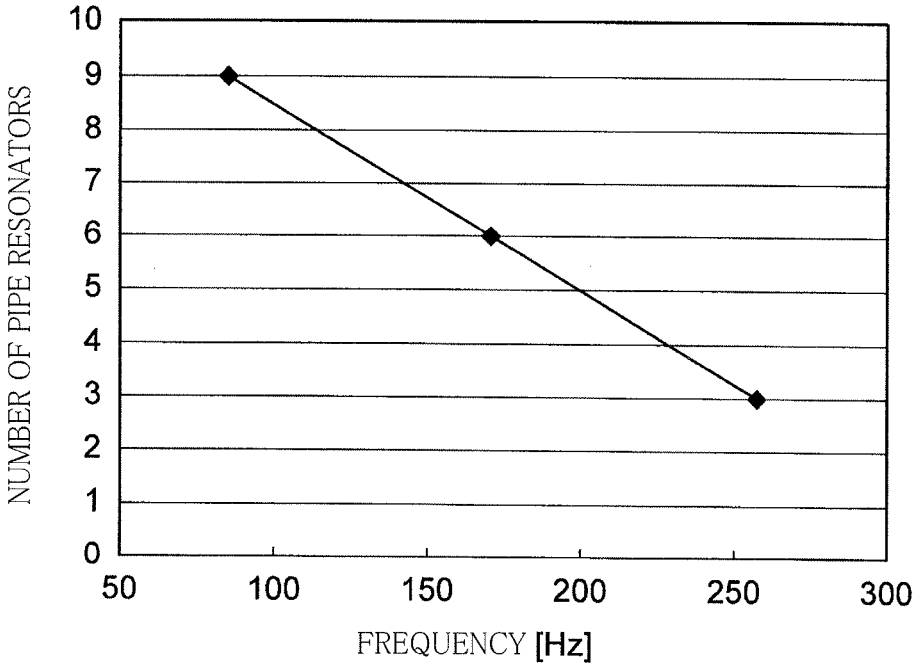
FIG. 13 is a graph showing a relationship between a frequency of the longitudinal axial wave and a number of square pipe resonators AP required for reducing a sound-pressure peak by about 5 dB from a sound-pressure peak in a case in which no pipe resonators AP are installed, the square pipe resonator AP having a cavity whose cross-sectional shape is a square with one side 15 mm in length.

The required number of the square pipe resonators AP, each having the cavity whose cross-sectional shape is the square with one side 15 mm in length, in the instance in which the sound-pressure-peak reduction amount becomes about 5 dB is nine in the first mode (85 Hz), six in the second mode (171 Hz), and three in the third mode (257 Hz). FIG. 13 is a graph showing a relationship between mode (frequency) of the longitudinal axial wave and number of square pipe resonators AP (i.e., total cross-sectional area of cavities of pipe resonator AP) required for reducing the sound-pressure peak by about 5 dB from the sound-pressure peak in the instance in which the pipe resonator AP is not installed, the square pipe resonator AP having the cavity whose cross-sectional shape is the square with one side 15 mm in length. As shown in FIG. 13, the sound frequency is substantially proportional to the number of the pipe resonators AP. Accordingly, for obtaining the same sound-pressure-peak reduction amount in the plurality of frequency bands of the sound, the total cross-sectional area of the cavities may be small for the high-frequency (high-mode) sound whereas a large total cross-sectional area of the cavities is necessary for the low-frequency (low-mode) sound. In other words, for obtaining the same sound scattering and sound absorbing effects for the plurality of frequency bands of the sound, the pipe resonator having a small total cross-sectional area of the cavities is sufficient for the high-frequency sound whereas the pipe resonator having a large total cross-sectional area of the cavities is required for the low-frequency sound.

In the acoustic structure according to the present embodiment, the pipe 110-1 that resonates with the lowest-frequency sound has four cavities and four openings. The pipe 110-2 that resonates with the second-lowest-frequency sound has three cavities and three openings. The pipe 110-3 that resonates with the third-lowest-frequency sound has two cavities and two openings. The pipes 110-4 to 110-6 each of which resonates with the corresponding high-frequency sound have one cavity and one opening. Thus, in the acoustic structure according to the present embodiment, the number of the cavities and the openings is made large in the pipes each of which resonates with the corresponding lower-frequency sound, whereby the total cross-sectional area of the cavities of each of those pipes is made large. Thus, the sound scattering and sound absorbing effects produced near the openings of the pipes each of which resonates with the corresponding lower-frequency sound are prevented from being lowered.

In the acoustic structure according to the present embodiment, the sound scattering and sound absorbing effects produced near the openings of the respective pipes can be variously controlled by designing, individually in the respective pipes, the number of the cavities, the cross-sectional area of the cavities, and the position of the openings. It is needless to mention that the number of the cavities, the cross-sectional area of the cavities, and the position of the openings are not limited to those illustrated in FIG. 1, in the acoustic structure according to the present embodiment.

The acoustic structure according to the present embodiment enjoys optimum advantages in a design aimed at a reduction in the thickness of the acoustic structure. Where the thickness of each pipe of the acoustic structure is merely reduced, there arise a problem of a reduction in the stiffness of each pipe and a problem of a reduction in the cross-sectional area of the cavities. The reduction in the stiffness of the pipe and the reduction in the cross-sectional area of the cavities both lead to a reduction in the sound scattering and sound absorbing effects produced near the openings. Where the wall thickness of the pipe is increased in an attempt to prevent the reduction in the stiffness of the pipe, the cross-sectional area of the cavities is further reduced. Where the wall thickness of the pipe is increased while maintaining the cross-sectional area of the cavities, the reduction in the thickness of the acoustic structure is not attained. Where the dimension of the cross section of the cavities (the pipe) in the thickness direction is reduced and the dimension of the cross section of the cavities (the pipe) in the width direction is increased in an attempt to prevent the reduction in the cross-sectional area of the cavities, the stiffness of the pipe is further reduced.

In contrast, the acoustic structure according to the present embodiment has a structure in which the cavity of the pipe is divided into the plurality of cavities, making it possible to secure the total cross-sectional area of the cavities without suffering from the reduction in the stiffness of the pipe. In other words, by providing the partitions in the cavity of the pipe, it is possible to avoid the reduction in the stiffness that is caused when the thickness of the acoustic structure is reduced. Further, by increasing the number of the cavities in the width direction of the cross section of the cavities, it is possible to increase the total cross-sectional area of the plurality of cavities more than the total cross-sectional area before the thickness is reduced, without reducing the stiffness. Further, the plurality of cavities are formed in the pipe. Accordingly, even if the cross-sectional area of each cavity is reduced, the sound scattering and sound absorbing effects to be produced can be increased by disposing the openings corresponding to the cavities concentratedly at the same position in the longitudinal direction of the pipe. Thus, in the acoustic structure according to the present embodiment, the thickness of the acoustic structure can be reduced without suffering from the reduction in the sound scattering and sound absorbing effects produced near the openings of the pipe.

As described above, in the acoustic structure according to the present embodiment, the plurality of cavities are formed in the pipe and the openings corresponding to the respective cavities are disposed at the same position in the longitudinal direction of the pipe, whereby the openings corresponding to the respective cavities are disposed adjacent to each other, namely, the openings are concentratedly disposed. As a result, the sound scattering and sound absorbing effects near the openings of the pipe can be increased. Accordingly, as compared with the conventional technique in which the sound scattering and sound absorbing effects near the openings of the pipe are increased by attaching the sound absorbing members, the manufacturing cost can be lowered in the present acoustic structure since the step of attaching the sound absorbing members are not included in the manufacturing process of the present acoustic structure. Since the pipe in which the plurality of cavities are formed therein can be easily manufactured by extrusion molding of synthetic resin or the like, the manufacturing cost is not increased. Moreover, the thickness of the acoustic structure can be reduced while ensuring the sound scattering and sound absorbing effects similar to those in the conventional acoustic structure.

Modified Embodiments

While there has been explained one embodiment of the present invention, the invention may be embodied otherwise as described below.

(1) In the illustrated embodiment shown in FIG. 1, the cavity of the pipe is divided such that the plurality of cavities are arranged side by side only in the width direction of the cross section of the pipe. The cavity of the pipe may be otherwise divided. For instance, the cavity of the pipe may be divided into a plurality of cavities such that the plurality of cavities are arranged in both of the width direction of the cross section of the pipe and thickness direction of the cross section of the pipe in the form of a matrix.

Figure 14A:
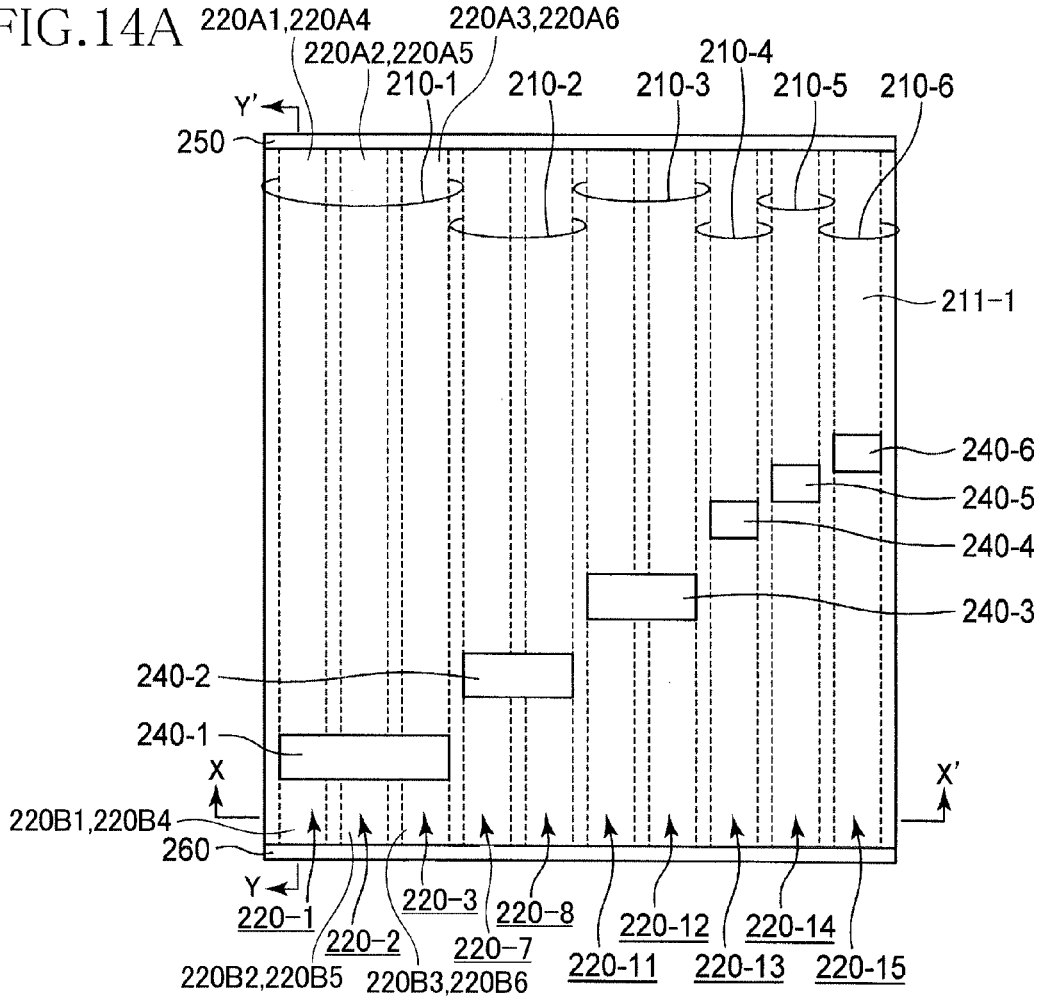
FIG. 14A is a front view and FIGS. 14B and 14C are cross-sectional views showing a configuration of an acoustic structure according to a first modified embodiment.
Figure 14B:
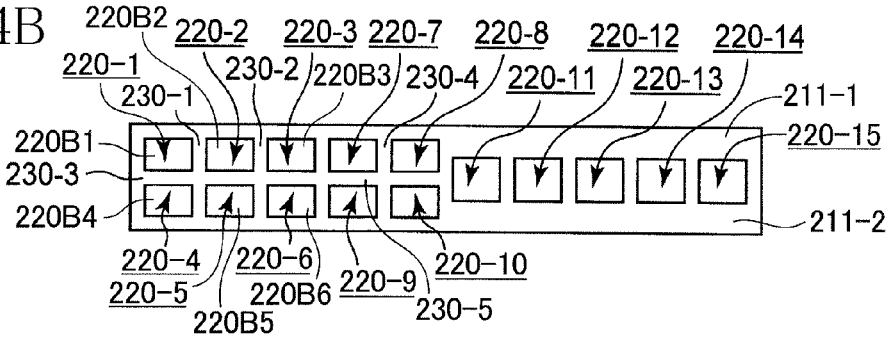
Figure 14C:
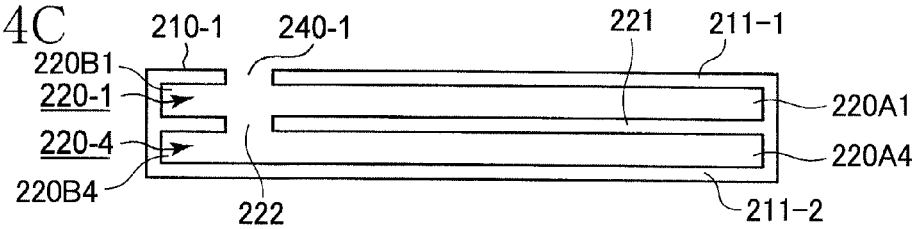

FIG. 14A is a front view showing a configuration of an acoustic structure according to a first modified embodiment. FIG. 14B is a cross-sectional view of the acoustic structure taken along line X-X'. FIG. 14C is a cross-sectional view of the acoustic structure taken along line Y-Y'. In the acoustic structure shown in FIG. 14, a cavity of a pipe 210-1 and a cavity of a pipe 210-2 are divided into a plurality of cavities such that the plurality of cavities are arranged in both of the width direction of the cross section of the pipe and the thickness direction of the cross section of the pipe in the form of a matrix.

The pipe 210-1 has six cavities **220-*m* (m=1 to 6) along its longitudinal direction. The cavities 220-*m* (m=1 to 6) are partitioned by partitions 230-*i* (i=1 to 2) extending in the thickness direction of the cross section of the pipe 210-1 (as one example of the third direction) and a partition 230-3 extending in the width direction of the cross section of the pipe 210-1 (as one example of the second direction), such that the cavities 220-*m* (m=1 to 6) are arranged in a matrix having two rows each extending in the width direction and three columns each extending in the thickness direction. The pipe 210-2 has four cavities 220-*m* (m=7 to 10) along its longitudinal direction. The cavities 220-*m* (m=7 to 10) are partitioned by a partition 230-4 extending in the thickness direction of the cross section of the pipe 210-2 and a partition 230-5 extending in the width direction of the cross section of the pipe 210-2, such that the cavities 220-*m* (m=7 to 10) are arranged in a matrix having two rows each extending in the width direction and two columns each extending in the thickness direction. A pipe 210-3 has two cavities 220-*m* (m=11 and 12) along its longitudinal direction. The cavities 220-*m* (m=11 and 12) are partitioned by a partition extending in the thickness direction of the cross section of the pipe 210-3. Each of pipes 210-*n* (n=4 to 6) has one cavity 220-*m* (m=13 to 15). The cavities 220-*m* (m=1 to 10) of the pipes 210-*n* (n=1 to 3) have the same cross-sectional area taken along the plane perpendicular to the longitudinal direction of the pipes 210-*n* (n=1 to 3). In this respect, in the first modified embodiment shown in FIG. 14, the cavities 220-*m* (m=1 to 15) of the pipes 210-*n*** (n=1 to 6) may have the same cross-sectional area, for instance.

On the front of the pipe 210-1, there is formed an opening 240-1 that permits the cavities **220-*m* (m=1 to 6) of the pipe 210-1 to communicate with an exterior space of the pipe 210-1 (i.e., acoustic space), at a prescribed position in the longitudinal direction of the pipe 210-1 (as one example of the first position). Similarly, on the front of the pipe 210-2, there is formed an opening 240-2 that permits the cavities 220-*m* (m=7 to 10) of the pipe 210-2 to communicate with an exterior space of the pipe 210-2 (i.e., acoustic space). As shown in FIG. 14C, the cavity 220-1 and the cavity 220-4 are partitioned by a partition 230-3 (as one example of a cavity-row partition). Similarly, the cavity 220-2 and the cavity 220-5 are partitioned by the partition 230-3, and the cavity 220-3 and the cavity 220-6 are partitioned by the partition 230-3. Further, the cavity 220-7 and the cavity 220-9 are partitioned by a partition 230-5, and the cavity 220-8 and the cavity 220-10 are partitioned by the partition 230-5. As shown in FIG. 14C, the cavity 220-4 is held in communication with the cavity 220-1 via a through-hole 222 formed in the partition 230-3. Similarly, the cavity 220-5 is held in communication with the cavity 220-2, and the cavity 220-6 is held in communication with the cavity 220-3, via the through-hole 222. Further, the cavity 220-9 is held in communication with the cavity 220-7, and the cavity 220-10 is held in communication with the cavity 220-8, via another through-hole formed in the partition 230-5. In this embodiment, the through-hole 222 has the same shape, in plan view, as the opening 240-1. The through-hole 222 may have a shape different from the shape of the opening 240-1. For instance, the cavity 220-1 may be held in communication with the cavity 220-4, the cavity 220-2 may be held in communication with the cavity 220-5, and the cavity 220-3 may be held in communication with the cavity 220-6, via respective three through-holes that are located at the same position in the longitudinal direction of the partition 230-3** and that are spaced apart from one another.

Where a part of each of the pipes **210-*n* (n=1 to 6) is defined by a flat plate portion 211-1 (as one example of the first flat plate portion) on the front side of the acoustic structure and a flat plate portion 211-2 (as one example of the second flat plate portion) on an opposite side of the front side, as shown in FIG. 14, the openings 240-*j* (j=1 to 6) are formed in the flat plate portion 211-1. In other words, each of the plurality of cavities 220-*m* (m=1 to 15) is partially defined by at least one of the flat plate portion 211-1 and the flat plate portion 212-1 that are arranged in the thickness direction of the cross section of the pipe 210-1 (as one example of the third direction), so as to be parallel to each other. The acoustic structure is installed in the acoustic space such that one of the two flat plate portions in which the openings 240-*j* (j=1 to 6) are formed, i.e., the flat plate portion 211-1, is disposed closer to the acoustic space. Further, the acoustic structure is installed in the acoustic space such that the longitudinal direction of the cavities and the cavity-arrangement direction in which the plurality of cavities are arranged are parallel to the wall or the ceiling of the acoustic space in which the acoustic structure is installed and such that the other of the two flat plate portions, i.e., the flat plate portion 211-2**, that is disposed more distant from the acoustic space, is opposed to the wall or the ceiling of the acoustic space.

At portions of the pipe 210-1 corresponding to the respective cavities **220-*m* (m=1 to 6), there are formed: resonance pipes 220A-1 to 220A-6 each having an open end defined by the opening 240-1 and a closed end defined by a plate 250; and resonance pipes 220B-1 to 220B-6 each having an open end defined by the opening 240-1 and a closed end defined by a plate 260. In this arrangement, the pipe 210-1 has a structure similar to that in which six resonance pipes having mutually the same resonance frequency are arranged in a matrix in both of the width direction and the thickness direction of the cross section of the pipe 210-1 indicated above. Similarly, at portions of the pipe 210-2 corresponding to the respective cavities 220-*m* (m=7 to 10), there are formed: resonance pipes 220A-7 to 220A-10 each having an open end defined by the opening 240-2 and a closed end defined by the plate 250; and resonance pipes 220B-7 to 220B-10 each having an open end defined by the opening 240-2 and a closed end defined by the plate 260. In this arrangement, the pipe 210-2 has a structure similar to that in which four resonance pipes having mutually the same resonance frequency are arranged in a matrix in both of the width direction and the thickness direction of the pipe 210-2** indicated above.

As in the illustrated embodiment, in this embodiment in which the cavity of the pipe is divided into the plurality of cavities in the form of a matrix, it is possible to increase the sound scattering and sound absorbing effects near the opening. The partition **230-*i* (i=1 to 5) may be constructed so as not to completely partition adjacent two cavities of the plurality of cavities 220-*m* (m=1 to 10). That is, as shown in FIG. 14, the partition 230-*i* (i=1 to 5) may be constructed so as not to be formed at positions in the longitudinal direction corresponding to the openings 240-1, 240-2. Such partitions 230-*i* (i=1 to 5) enable the sound scattering and sound absorbing effects near the opening to be increased while preventing the stiffness of the pipe from being lowered, as in the illustrated embodiment shown in FIG. 1**.

Figure 15:
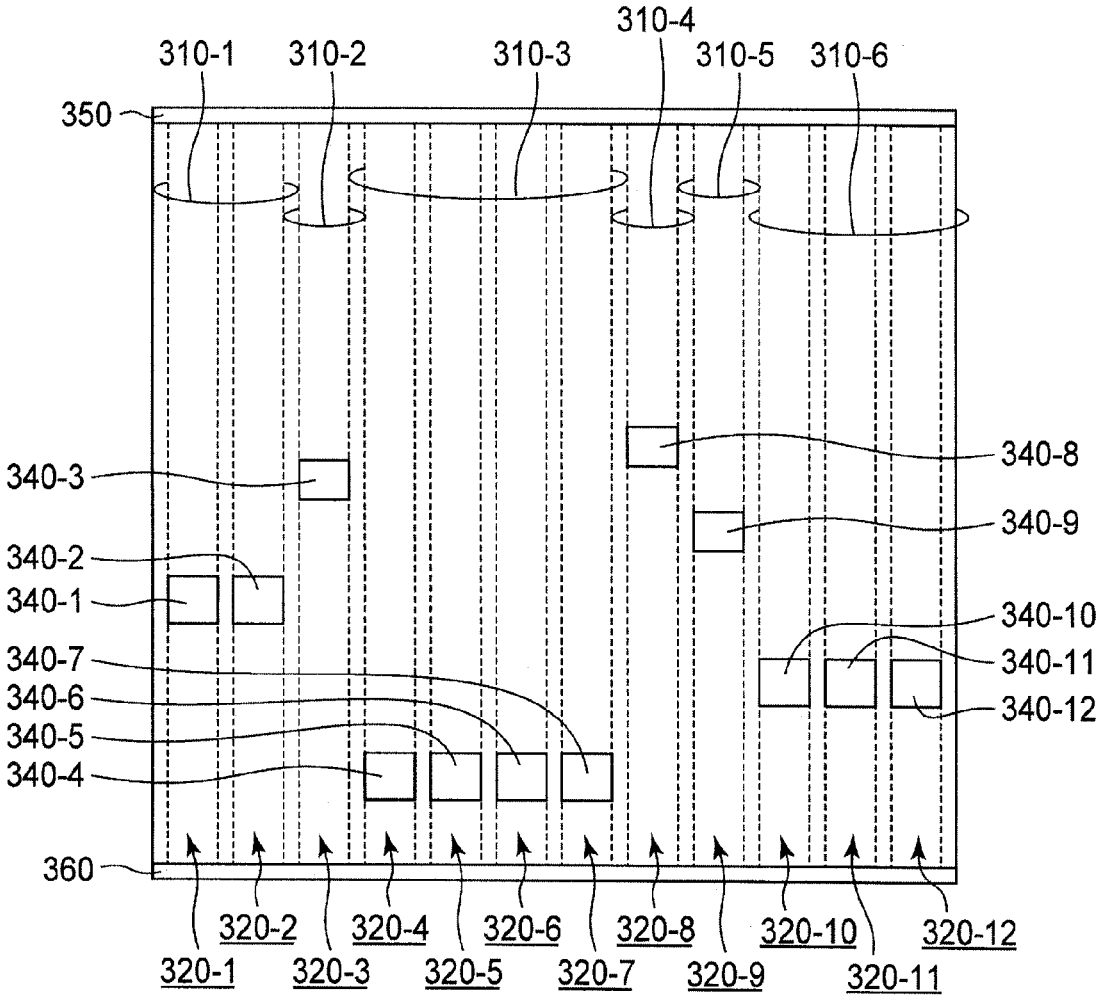
FIG. 15 is a front view showing a configuration of an acoustic structure according to a second modified embodiment.

(2) In the acoustic structure according to the illustrated embodiment shown in FIG. 1, the pipes are arranged such that the leftmost pipe in FIG. 1 corresponds to the lowest resonance frequency and such that the resonance frequency corresponding to each pipe gradually increases from the left to the right in FIG. 1. The pipes may be arranged such that the rightmost pipe of the acoustic structure corresponds to the lowest resonance frequency and such that the resonance frequency corresponding to each pipe gradually increases from the right to the left in FIG. 1. Further, it is not necessary for the resonance frequency corresponding to each pipe to gradually increase or decrease in the width direction of the acoustic structure. That is, the pipes may be arranged such that the resonance frequency corresponding to each pipe may be arbitrary in the direction from the left to the right in the acoustic structure. In this instance, a group of cavities of one pipe functioning as a group of resonance pipes corresponding to mutually the same resonance frequency is maintained. FIG. 15 shows one example of this arrangement as a second modified embodiment. An acoustic structure shown in FIG. 15 has the following pipes disposed in the order of description in a direction from the left to the right in FIG. 15: a pipe 310-1 having two cavities, i.e., a cavity 320-1 corresponding to an opening 340-1 and a cavity 320-2 corresponding to an opening 340-2; a pipe 310-2 having a cavity 320-3 corresponding to an opening 340-3; a pipe 310-3 having four cavities, i.e., a cavity 320-4 corresponding to an opening 340-4, a cavity 320-5 corresponding to an opening 340-5, a cavity 320-6 corresponding to an opening 340-6, and a cavity 320-7 corresponding to an opening 340-7; a pipe 310-4 having a cavity 320-8 corresponding to an opening 340-8; a pipe 310-5 having a cavity 320-9 corresponding to an opening 340-9; and a pipe 310-6 having three cavities, i.e., a cavity 320-10 corresponding to an opening 340-10, a cavity 320-11 corresponding to an opening 340-11, and a cavity 320-12 corresponding to an opening 340-12. As in the acoustic structure of the illustrated embodiment shown in FIG. 1, in the acoustic structure shown in FIG. 15, the cavities of each of the pipes 310-1, 310-3, 310-6 are partitioned by corresponding partitions. The cavities **320-*m* (m=1 to 12) of the pipes 310-*n* (n=1 to 6) may have the same cross-sectional area taken along the plane perpendicular to the longitudinal direction of the pipes. As in the illustrated embodiment shown in FIG. 1, the openings 340-*j*** (j=1 to 12) are formed in one of the two flat plate portions that is closer to the acoustic space in a state in which the acoustic structure is installed in the acoustic space.

Figure 16A:
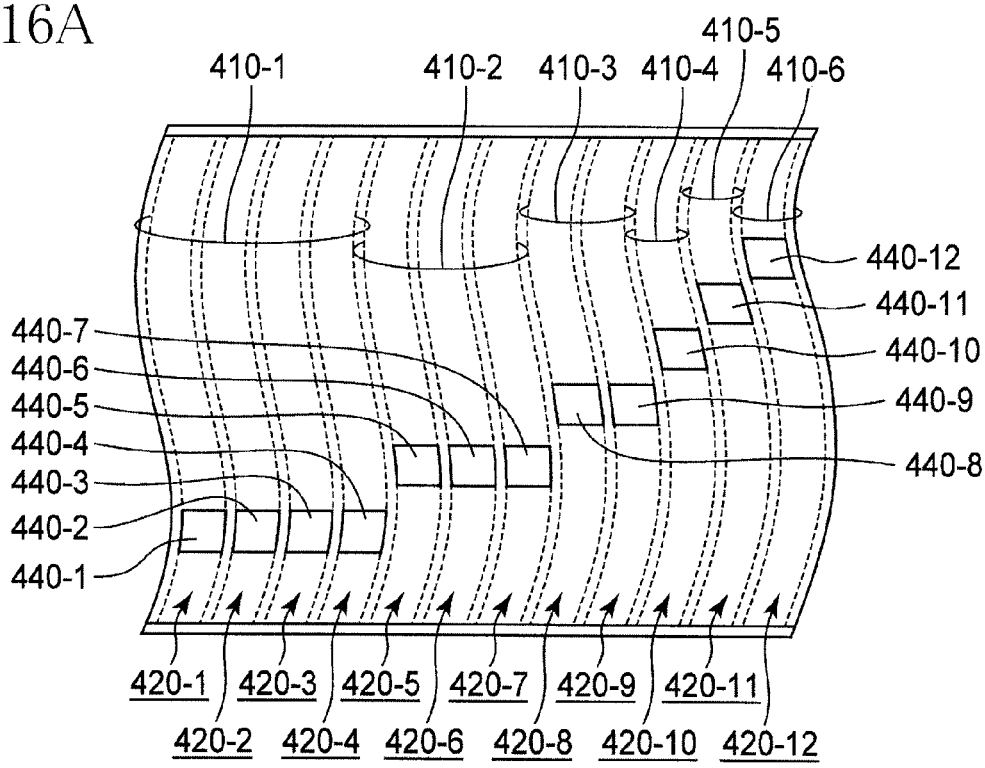
FIG. 16A is a front view and 16B is a perspective view each showing a configuration of an acoustic structure according to a third modified embodiment.
Figure 16B:
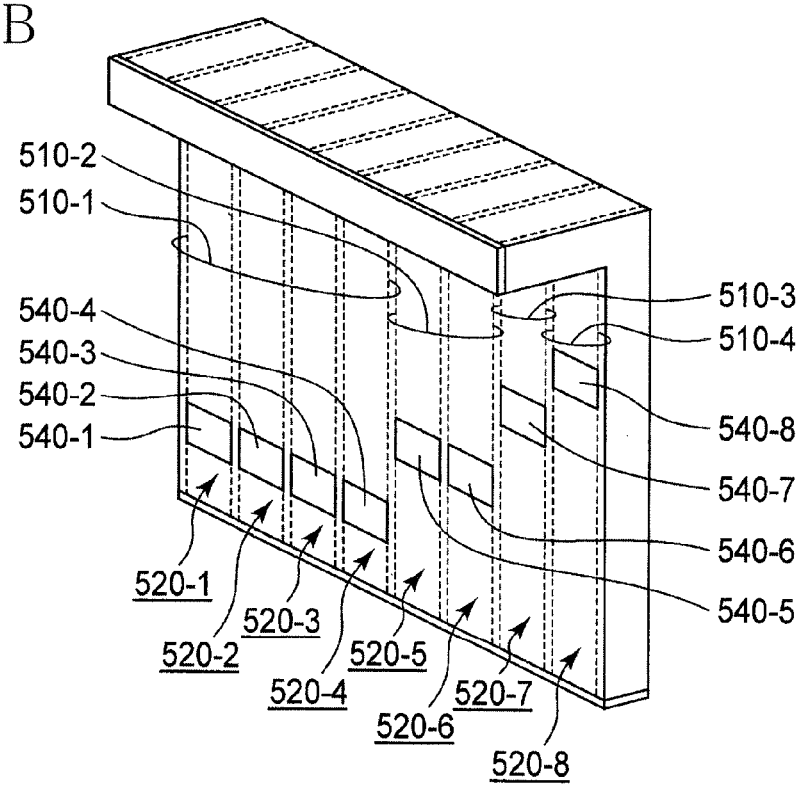

(3) The acoustic structure of the illustrated embodiment shown in FIG. 1 is constituted by the linear pipes extending in the longitudinal direction thereof. The pipes of the acoustic structure are not limited to such linear ones extending in the longitudinal direction. For instance, the pipes may be curved or bent with respect to the longitudinal direction of the pipes, as long as a group of cavities of one pipe functions as a group of resonance pipes corresponding to mutually the same resonance frequency. FIGS. 16A and 16B respectively show acoustic structures according to a third modified embodiment. FIG. 16A is a front view showing an acoustic structure constituted by pipes that are curved with respect to the longitudinal direction thereof. The acoustic structure shown in FIG. 16A is curved in its width direction. Because a group of resonance pipes formed in the respective cavities 420-1 to 420-4 of the pipe 410-1 corresponds to mutually the same resonance frequency, the sound scattering and sound absorbing effects produced near the openings 440-1 to 440-4 can be increased, as in the illustrated embodiment. In the acoustic structure shown in FIG. 16A, the cavities of each of the pipes 410-1, 410-2, 410-3 are partitioned by corresponding partitions, as in the illustrated embodiment of FIG. 1. Further, the cavities **420-*m* (m=1 to 12) of the pipes 410-*n* (n=1 to 6) may have the same cross-sectional area taken along the plane perpendicular to the longitudinal direction of the pipes. As in the illustrated embodiment of FIG. 1, the openings 440-*j* (j=1~12) are formed in one of the two flat plate portions that is closer to the acoustic space in a state in which the acoustic structure is installed in the acoustic space. FIG. 16B is a perspective view showing an acoustic structure constituted by pipes that are bent with respect to the longitudinal direction of the pipes. The acoustic structure shown in FIG. 16B is bent at an intermediate position in the longitudinal direction of the pipes so as to be parallel to the thickness direction of the pipes. Because a group of resonance pipes formed in the respective cavities 520-1 to 520-4 of the pipe 510-1 corresponds to mutually the same resonance frequency, the sound scattering and sound absorbing effects produced near the openings 540-1 to 540-4 can be increased, as in the illustrated embodiment. The acoustic structure constituted by the pipes that are curved or bent with respect to the longitudinal direction can be installed at various positions. For instance, the acoustic structure shown in FIG. 16B may be installed such that the bent portion of the acoustic structure fits to a corner portion defined by the ceiling and the inner wall of the acoustic space. In the acoustic structure shown in FIG. 16B, the cavities of each of the pipes 510-1, 510-2 are partitioned by corresponding partitions. Further, the cavities 520-*m* (m=1 to 8) of the pipes 510-*n* (n=1 to 4) may have the same cross-sectional area taken along the plane perpendicular to the longitudinal direction of the pipes. The openings 540-*j*** (j=1 to 8) are formed in one of the two flat plate portions that is closer to the acoustic space in a state in which the acoustic structure is installed in the acoustic space, as in the illustrated embodiment.

(4) In the acoustic structure of the illustrated embodiment, the cavity of each of the pipes is divided into the plurality of cavities, such that the plurality of cavities of all of the pipes have the same cross-sectional area taken along the plane perpendicular to the longitudinal direction of the pipe. The cross-sectional area of the cavities may differ for each of the pipes. For instance, among the pipes that constitute the acoustic structure, the pipe having a longer pipe length, namely, the pipe in which the resonance pipe formed therein has a longer length, may have the cavities whose cross-sectional area is smaller, in other words, the interior of such a pipe may be finely divided into a larger number of cavities, as compared with the pipe having a shorter pipe length, namely, the pipe in which the resonance pipe formed therein has a shorter length. By more finely dividing the interior of the pipe, the partitions that resist a stress are increased, resulting in increased stiffness of the pipe wall. The cavity (the interior) of the pipe having a longer pipe length is finely divided because the pipe corresponding to a lower frequency, namely, the pipe having a longer pipe length, tends to suffer from a decrease in the sound scattering and sound absorbing effects due to a decrease in the stiffness of the pipe wall and it is therefore required to increase the stiffness of the pipe wall in the pipe corresponding to a lower frequency.

(5) The pipes of the acoustic structure in the illustrated embodiment is formed by extrusion molding of synthetic resin. The material of the pipes is not limited to synthetic resin. That is, the pipes may be formed of any material such as wood or metal by any method.

(6) The acoustic structure in the illustrated embodiment is constituted by the six pipes **110-*n*** (n=1 to 6). This is for an illustrative purpose, and the number of the pipes that constitute the acoustic structure is not particularly limited.

(7) In the acoustic structure in the illustrated embodiment, the cross-sectional shape of the cavities of the pipes is a generally square. The cross-sectional shape of the cavities is not limited to the square, but may be any arbitrary shape.

(8) In the acoustic structure shown in FIG. 1, the plurality of pipes including the pipe 110-1 having the four cavities and the pipe 110-2 having the three cavities are arranged side by side in the width direction so as to constitute the acoustic structure. The acoustic structure may be otherwise constructed.

Figure 17A:
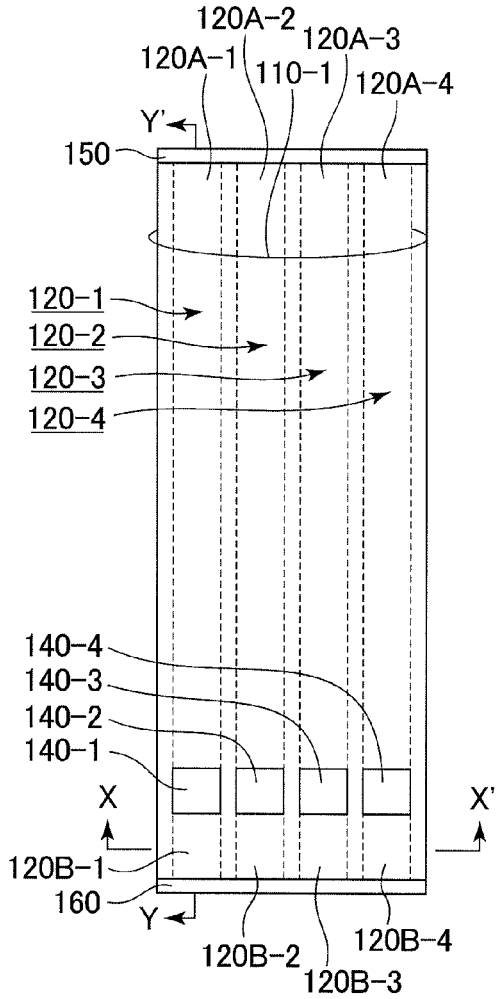
FIG. 17A is a front view and FIGS. 17B and 17C are cross-sectional views showing a configuration of an acoustic structure according to a fourth modified embodiment.
Figure 17B:
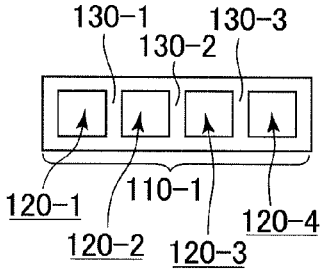
Figure 17C:
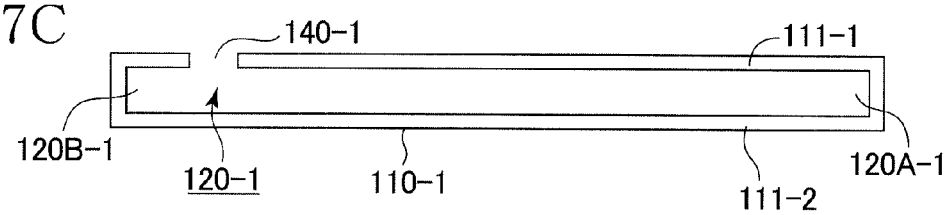
Figures 18A, 18B, 18C:
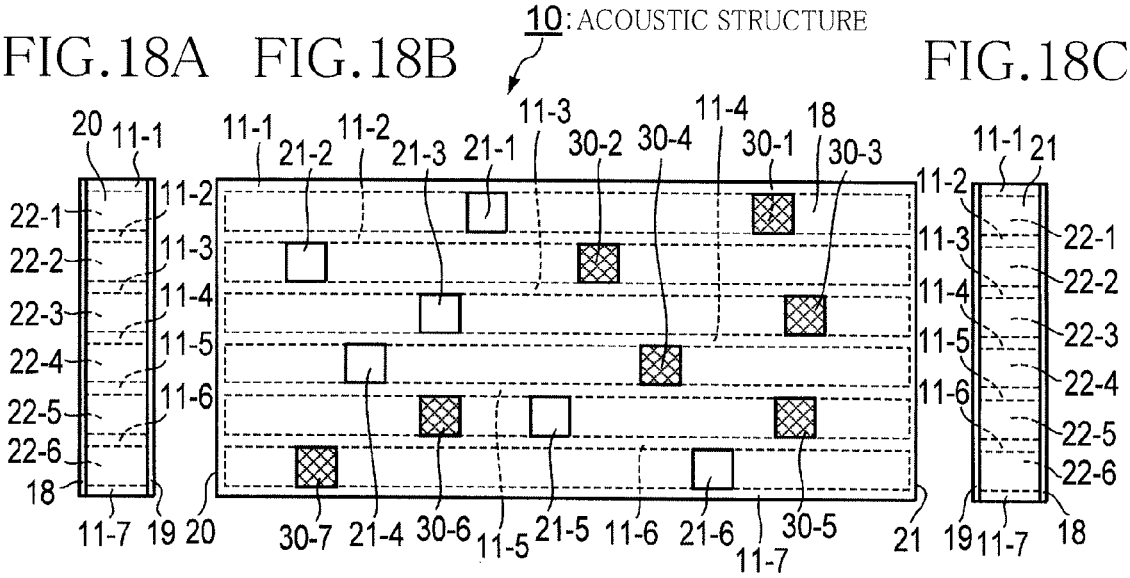
FIG. 18A is a front view and FIGS. 18B and 18C are cross-sectional views showing a configuration of an acoustic structure disclosed in the Patent Literature 1.

FIG. 17A is a front view showing a configuration of an acoustic structure according to a fourth modified embodiment. FIG. 17B is a cross-sectional view of the acoustic structure taken along line X-X'. FIG. 17C is a cross-sectional view of the acoustic structure taken along line Y-Y'. The acoustic structure of FIG. 17 is identical in configuration to the acoustic structure of FIG. 1 except that the acoustic structure of FIG. 17 is constituted only by the pipe 110-1 that is one of the six pipes **110-*n* (n=1 to 6) in the acoustic structure of FIG. 1. The pipe 110-1 has four cavities along the longitudinal direction thereof. As in the acoustic structure of FIG. 1**, in the thus constructed acoustic structure, it is possible to suppress a reduction in the stiffness caused when the thickness of the acoustic structure is reduced, by providing partitions that partition the cavities in the pipe. It is also possible to reduce the thickness of the acoustic structure without suffering from a reduction in the sound scattering and sound absorbing effects produced near the openings of the pipes.

The acoustic structure may be constituted by two pipes, e.g., the pipe 110-1 and the pipe 110-2, among the six pipes **110-*n* (n=1 to 6) of the acoustic structure of FIG. 1. In this instance, the acoustic structure is constituted by the two pipes each having a plurality of cavities. In this acoustic structure, the position, in the longitudinal direction, of the openings of one of the two pipes differs from the position, in the longitudinal direction, of the openings of the other of the two pipes. Further, the acoustic structure may be constituted by two pipes, e.g., the pipe 110-1 and the pipe 110-4, among the six pipes 110-*n* (n=1 to 6) of the acoustic structure of FIG. 1. In this instance, the acoustic structure is constituted by the pipe 110-1 having a plurality of cavities and the pipe 110-4 having one cavity. In this acoustic structure, the position, in the longitudinal direction, of the openings of one of the two pipes differs from the position, in the longitudinal direction, of the opening of the other of the two pipes. The thus constructed acoustic structures also ensure advantages similar to those ensured in the acoustic structure of FIG. 1**.

What is claimed is:

1. An acoustic structure, comprising a first pipe and a second pipe each having a plurality of cavities that are partitioned by a partition, each of the plurality of cavities extending in a first direction that is a longitudinal direction of the first and second pipes, the plurality of cavities of the first pipe and the second pipe being arranged in a second direction that is perpendicular to the first direction, wherein the first pipe has a plurality of openings which permit the plurality of cavities of the first pipe to communicate with an exterior of the first pipe, the plurality of openings being arranged in the second direction and being provided for at least two cavities, which are adjacent to each other in the second direction, of the plurality of cavities of the first pipe, a position of each of the plurality of openings in the first direction being a first position, wherein the second pipe has a plurality of openings which permit the plurality of cavities of the second pipe to communicate with an exterior of the second pipe, the plurality of openings being arranged in the second direction and being provided for at least two cavities, which are adjacent to each other in the second direction, of the plurality of cavities of the second pipe, a position of each of the plurality of openings in the first direction being a second position that is different from the first position, wherein lengths of the plurality of cavities of the first pipe in the first direction are the same as each other, wherein the plurality of openings of the first pipe are formed such that each of the plurality of cavities of the first pipe has a first resonance frequency, and wherein the plurality of openings of the second pipe are formed such that each of the plurality of cavities of the second pipe has a second resonance frequency that is different from the first resonance frequency.

2. The acoustic structure according to claim 1, wherein the plurality of cavities of the first pipe and the second pipe have the same cross-sectional area taken along a plane perpendicular to the first direction.

3. The acoustic structure according to claim 1, wherein each of the plurality of cavities of the first pipe and the second pipe is partially defined by a first flat plate portion and a second flat plate portion that are arranged in a third direction so as to be parallel to each other, the third direction being perpendicular to the first direction and the second direction, and wherein each of the plurality of openings is formed in the first flat plate portion.

4. The acoustic structure according to claim 3, which is to be installed in an acoustic space such that the first direction and the second direction are parallel to a wall or a ceiling of the acoustic space and such that the second flat plate portion is opposed to the wall or the ceiling.

5. The acoustic structure according to claim 1, wherein the first pipe and the second pipe are disposed so as to be arranged in the second direction.

6. The acoustic structure according to claim 5, wherein a number of the plurality of cavities of the first pipe is greater than or equal to a number of the plurality of cavities of the second pipe, the first pipe having a first distance that is larger than a second distance of the second pipe, the first distance being a larger one of distances between respective opposite ends in the first direction of the first pipe and the plurality of opening of the first pipe, the second distance being a larger one of: distances between respective opposite ends in the first direction of the second pipe and the plurality of openings of the second pipe.

7. The acoustic structure according to claim 1, wherein lengths of the plurality of cavities of the second pipe in the first direction are the same as each other.

8. The acoustic structure according to claim 7, wherein each of the lengths of the plurality of cavities of the first pipe is the same as each of the lengths of the plurality of cavities of the second pipe.

* * * * *